US007838191B2

(12) United States Patent
Kuboshima et al.

(10) Patent No.: US 7,838,191 B2
(45) Date of Patent: Nov. 23, 2010

(54) ELECTROPHOTOGRAPHIC PHOTOCONDUCTOR HAVING TITANYL PHTHALOCYANINE AND IMAGE FORMING APPARATUS

(75) Inventors: Daisuke Kuboshima, Osaka (JP); Kazunari Hamasaki, Osaka (JP); Yuko Iwashita, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 869 days.

(21) Appl. No.: 11/717,274

(22) Filed: Mar. 12, 2007

(65) Prior Publication Data

US 2007/0218379 A1 Sep. 20, 2007

(30) Foreign Application Priority Data

Mar. 17, 2006 (JP) ..... 2006-073971

(51) Int. Cl.
*G03G 5/06* (2006.01)

(52) U.S. Cl. ..... 430/78; 430/56; 399/159

(58) Field of Classification Search ..... 430/56, 430/78; 399/159
See application file for complete search history.

(56) References Cited

U.S. PATENT DOCUMENTS 4,898,799 A * 2/1990 Fujimaki et al. ..... 430/78
5,166,339 A * 11/1992 Duff et al. ..... 430/78
5,246,807 A * 9/1993 Kanemaru et al. ..... 430/96
5,666,607 A * 9/1997 Camis ..... 399/176
6,190,812 B1 * 2/2001 Imanaka et al. ..... 430/83
6,528,645 B1 * 3/2003 Hamasaki et al. ..... 540/141
6,749,979 B2 * 6/2004 Takeuchi et al. ..... 430/78
2004/0096761 A1 * 5/2004 Lin et al. ..... 430/96
2006/0160005 A1 * 7/2006 Kuboshima et al. ..... 430/96

FOREIGN PATENT DOCUMENTS

JP 07-036204 2/1995

* cited by examiner

*Primary Examiner*—Christopher RoDee
(74) *Attorney, Agent, or Firm*—Carmody & Torrance LLP

(57) ABSTRACT

The present invention provides a monolayer type electrophotographic photoconductor which can effectively suppress the generation of an exposure memory and exhibits high sensitivity and an image forming apparatus using the monolayer type electrophotographic photoconductor. In an electrophotographic photoconductor which has a monolayer type photoconductive layer including at least a charge generating agent, a hole transfer agent, an electron transfer agent and a binding resin on a substrate, the charge generating agent contains oxo-titanyl phthalocyanine crystal, the electron transfer agent has a reduction potential thereof set to a value which falls within a range from −0.97 to −0.83 V, and the reflection absorbance (A/−) of the photoconductive layer with respect to light having a wavelength of 700 nm, a film thickness (d/m) of the photoconductive layer, and the concentration (C/weight %) of the oxo-titanyl phthalocyanine crystal of the photoconductive layer (100 weight %) satisfy a following formula (1).

$$A \cdot C^{-1} \cdot d^{-1} > 1.75 \times 10^4 \quad (1)$$

5 Claims, 7 Drawing Sheets

(A)

(B)

ELECTROPHOTOGRAPHIC PHOTOCONDUCTOR HAVING TITANYL PHTHALOCYANINE AND IMAGE FORMING APPARATUS

BACKGROUND OF THE INVENTION

1. Field of the Invention

The present invention relates to an electrophotographic photoconductor and an image forming apparatus, and more particularly, to an electrophotographic photoconductor which can effectively suppress the generation of an exposure memory and an image forming apparatus using the electrophotographic photoconductor.

2. Description of the Related Art

In general, as an electrophotographic photoconductor which serves for an electrophotographic machine such as a copying machine or a laser printer, recently, an organic photoconductor is popularly used to cope with demands such as reduction of cost and the low environmental contamination.

Further, an image forming process which is performed by following steps is adopted with respect to such an organic photoconductor. That is, a surface of the organic photoconductor is charged (main charging step) and an electrostatic latent image is formed on the surface of the organic photoconductor (exposure step) After the formation of the electrostatic latent image, a toner image is developed by applying a developing bias voltage to the electrostatic latent image (developing step). Then, the formed toner image is transferred to a transfer sheet by an inversion developing method (transfer step), and the transferred image is fixed by heating thus forming a desired image.

Then, a residual toner on the organic photoconductor is removed by using a cleaning blade (cleaning step), while a residual charge on the organic photoconductor is erased by an LED or the like (electricity neutralizing step).

However, such an organic photoconductor is used in a state that the organic photoconductor is rotated. Accordingly, there arises a phenomenon (exposure memory) in which a potential of the exposed portion (bright potential) in a preceding cycle remains and hence, also the charging step of next cycle is applied to the organic photoconductor, a desired charging potential (dark potential) cannot be obtained in such a portion.

Accordingly, the image density differs between the portion where the exposure memory is present and the portion where the exposure memory is not present thus giving rise to a drawback that a favorable image cannot be obtained.

Accordingly, to provide an electrophotographic photoconductor which exhibits a least change of potential even when the electrophotographic photoconductor is used repeatedly, there has been proposed an electrophotographic photoconductor which is formed of a negative-charged multilayer type organic photoconductor which specifies a material to be used as a charge transport agent and, at the same time, defines the difference between respective ionization potentials of a charge transport layer and a charge generation layer (for example, patent document 1).

[Patent Document 1] JP-A-7-36204 (claims)

SUMMARY OF THE INVENTION

However, the electrophotographic photoconductor which is disclosed in patent document 1, is limited to the negative-charged multilayer type organic photoconductor and hence, a drawback that the exposure memory cannot be yet suppressed is observed with respect to other photoconductor types. Particularly, with respect to the photoconductor which has an elongated electron transport distance such as the positive charged monolayer type photoconductor, there has been observed a drawback that the exposure memory conspicuously occurs.

Further, in an image forming apparatus which provides the above-mentioned positive charged monolayer type photoconductor or the like and does not include an electricity neutralizing means, the generation of the exposure memory is observed more conspicuously.

Here, as factors which make the electron transport distance in the positive charged monolayer type photoconductor influence the exposure memory, a fact that an electron transfer agent having the mobility comparable to the mobility of a hole transfer agent has not been developed yet, and a fact that the monolayer type photoconductor exhibits a low charge transport efficiency compared to a charge transport efficiency of the multilayer type photoconductor and the like are named.

Still further, as has been described above, while there exists a demand for the development of the technique which suppresses the generation of the exposure memory, there also exists a demand for the high-speed operation of the image forming apparatus. Accordingly, the electrophotographic photoconductor is required to possess the high sensitivity to the exposure.

Accordingly, the inventors of the present invention have made extensive studies and, as a result of the studies, the inventors have found out that in a monolayer type photoconductor, by allowing the reflection absorbance, a film thickness and the like of a photoconductive layer to satisfy a predetermined relationship and, as well as, by limiting a kind of a charge generating agent to be used and properties of an electron transfer agent to be used, the sensitivity may be enhanced in addition to the suppression of the exposure memory.

That is, it is an object of the present invention to provide a monolayer type electrophotographic photoconductor which can effectively suppress the exposure memory and can exhibit the high sensitivity and an image forming apparatus which uses such a monolayer type electrophotographic photoconductor.

According to a first aspect of the present invention, there is provided an electrophotographic photoconductor which has a monolayer type photoconductive layer including at least a charge generating agent, a hole transfer agent, an electron transfer agent and a binding resin on a substrate, wherein the charge generating agent contains oxo-titanyl phthalocyanine crystal, the electron transfer agent has a reduction potential thereof set to a value which falls within a range from −0.97 to −0.83 V, and the reflection absorbance (A/−) of the photoconductive layer with respect to light having a wavelength of 700 nm, a film thickness (d/m) of the photoconductive layer, and the concentration (C/weight %) of the oxo-titanyl phthalocyanine crystal of the photoconductive layer (100 weight %) satisfy a following formula (1). Due to the electrophotographic photoconductor of the present invention, it is possible to overcome the above-mentioned drawbacks.

$$A \cdot C^{-1} \cdot d^{-1} > 1.75 \times 10^4 \quad (1)$$

That is, by allowing the photoconductive layer to satisfy the properties expressed by the formula (1), the dispersibility of the oxo-titanyl phthalocyanine crystal in the photoconductive layer is improved and hence, it is possible to effectively suppress the exposure memory.

Further, by setting the reduction potential of the electron transfer agent to be used to the value which falls within the predetermined range, it is possible to effectively transport electrons generated by the charge generating agent and hence, the exposure memory may be suppressed more effectively.

Still further, the exposure memory may be suppressed in the above-mentioned manner and hence, the electrons may be efficiently moved in the photoconductive layer whereby the sensitivity at the time of performing the exposure may be also enhanced.

Further, in constituting the electrophotographic photoconductor of the present invention, the charge generating agent preferably includes the oxo-titanyl phthalocyanine crystal having the Y-type crystal structure.

Due to such a constitution, the photoconductive layer can easily satisfy the formula (1) and hence, it may be possible to provide the electrophotographic photoconductor which can reduce the generation of the exposure memory and, at the same time, exhibits the excellent sensitivity.

Further, in constituting the electrophotographic photoconductor of the present invention, the charge generating agent may preferably contain the oxo-titanyl phthalocyanine crystal which possesses following properties (a) and (b) or either one of these properties (a) and (b).

(a) In the differential scanning calorimetry analysis, the oxo-titanyl phthalocyanine crystal does not have peaks within a range from 50° C. to 400° C. except for peaks attributed to the vaporization of absorption water.

(b) In the differential scanning calorimetry analysis, the oxo-titanyl phthalocyanine crystal does not have peaks within a range from 50° C. to 200° C. except for peaks attributed to vaporization of absorption water and has one peak within a range from 200° C. to 400° C.

Due to such a constitution, the stability with time and the dispersibility of the oxo-titanyl phthalocyanine crystal in a photoconductive layer coating liquid at the time of manufacturing the photoconductive layer may be further enhanced.

Further, in constituting the electrophotographic photoconductor of the present invention, the charge generating agent may preferably further contain oxo-titanyl phthalocyanine crystal other than the oxo-titanyl phthalocyanine crystal having properties (a) or (b).

By using the oxo-titanyl phthalocyanine crystal having the plurality of properties as the charge generating agent, it may be possible to provide the electrophotographic photoconductor which can easily satisfy the formula (1) and may be manufactured at a low cost.

Further, in constituting the electrophotographic photoconductor of the present invention, the electrophotographic photoconductor may preferably contain oxo-titanyl phthalocyanine crystal having a following property (c) as the oxo-titanyl phthalocyanine crystal.

(c) After immersing the electrophotographic photoconductor in an organic solvent for 24 hours, in a CuKα-property X-ray diffraction spectrum, a maximum peak appears at least at a Bragg angle of $2\theta \pm 0.2° = 27.2°$ and a peak is not present at the Bragg angle of 26.2 °.

Due to such a constitution, the stability with time and dispersibility of the oxo-titanyl phthalocyanine crystal in the photoconductive layer coating liquid may be further enhanced.

Further, in constituting the electrophotographic photoconductor of the present invention, the concentration of oxo-titanyl phthalocyanine (C/weight %) in the monolayer type photoconductive layer (100 weight %) may preferably be set to a value which falls within a range from 0.6 to 3.0 weight %.

Due to such a constitution, the electrophotographic photoconductor can easily satisfy the formula (1) and hence, it may be possible to easily manufacture the photoconductive layer which exhibits the favorable dispersibility of oxo-titanyl phthalocyanine crystal and sensitivity and, at the same time, has a uniform thickness.

Further, according to another aspect of the present invention, there is provided an image forming apparatus which includes an electrophotographic photoconductor, wherein the electrophotographic photoconductor has a monolayer type photoconductive layer including at least a charge generating agent, a hole transfer agent, an electron transfer agent and a binding resin on a substrate thereof, the charge generating agent contains oxo-titanyl phthalocyanine crystal, the electron transfer agent has a reduction potential thereof set to a value which falls within a range from −0.97 to −0.83 V, and the reflection absorbance (A/−) of the photoconductive layer with respect to light having a wavelength of 700 nm, a film thickness (d/m) of the photoconductive layer, and the concentration (C/weight %) of the oxo-titanyl phthalocyanine crystal in the photoconductive layer (100 weight %) satisfy a following formula (1).

$$A \cdot C^{-1} \cdot d^{-1} > 1.75 \times 10^4 \quad (1)$$

That is, by allowing the photoconductive layer to satisfy the properties expressed by the formula (1), the dispersibility of the oxo-titanyl phthalocyanine crystal in the photoconductive layer can be improved and hence, it is possible to effectively suppress the exposure memory.

Further, by setting the reduction potential of the electron transfer agent to be used to the value which falls within the predetermined range, it is possible to more effectively suppress the exposure memory.

Still further, the exposure memory may be suppressed in the above-mentioned manner and hence, the charges may be efficiently moved in the photoconductor whereby the sensitivity at the time of performing the exposure may be also enhanced.

Accordingly, it is possible to provide an image forming apparatus such as a printer or a copying machine which can print a high-quality image in which the exposure memory is suppressed at a high speed.

Further, in constituting the image forming apparatus of the present invention, the image forming apparatus may preferably not include an electricity neutralizing means.

By constituting the image forming apparatus as an electricity neutralizing means less type which does not require the electricity neutralizing means, the image forming apparatus may be miniaturized or simplified and, at the same time, the exposure memory may be also sufficiently suppressed.

PREFERRED EMBODIMENT OF THE INVENTION

According to the first embodiment of the present invention, in an electrophotographic photoconductor which has a monolayer type photoconductive layer including at least a charge generating agent, a hole transfer agent, an electron transfer agent and a binding resin on a substrate, the charge generating agent contains oxo-titanyl phthalocyanine crystal, the electron transfer agent has a reduction potential thereof set to a value which falls within a range from −0.97 to −0.83 V, and the reflection absorbance (A/−) of the photoconductive layer with respect to light having a wavelength of 700 nm, a film thickness (d/m) of the photoconductive layer, and the concentration (C/weight %) of the oxo-titanyl phthalocyanine crystal of the photoconductive layer (100 weight %) satisfy a following formula (1).

$$A \cdot C^{-1} \cdot d^{-1} > 1.75 \times 10^4 \quad (1)$$

Hereinafter, the electrophotographic photoconductor of the first embodiment is explained by dividing the electrophotographic photoconductor into respective constitutional features.

1. Basic Constitution

Figure 1:
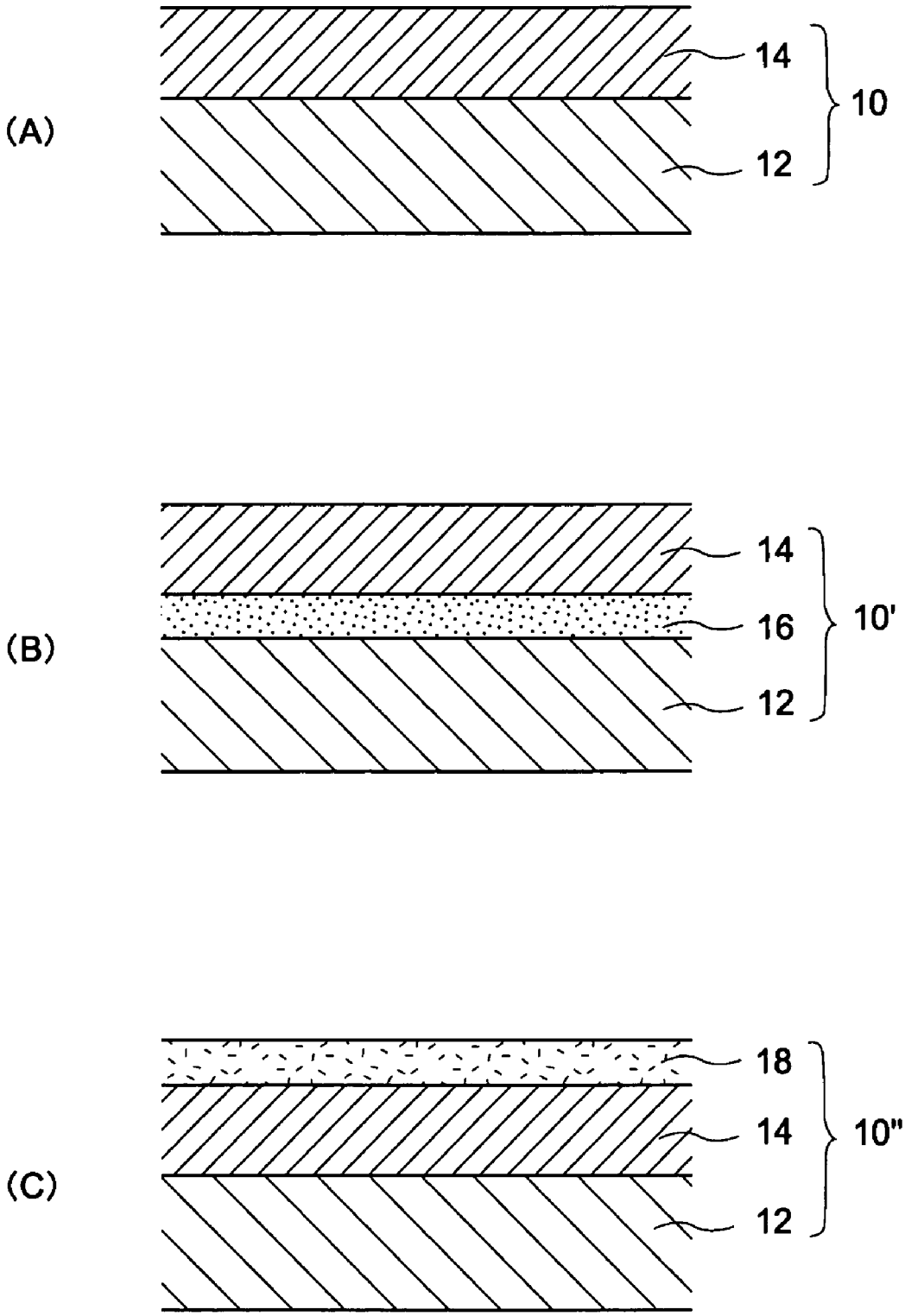
FIG. 1A to FIG. 1C are views for explaining the constitution of a monolayer photoconductor.

As shown in FIG. 1A, the monolayer type photoconductor 10 is formed by mounting a single photoconductive layer 14 on a base body (a conductive base body) 12. Such a photoconductive layer 14 is characterized by containing oxo-titanyl phthalocyanine crystal which constitutes a charge generating agent, a hole transfer agent, an electron transfer agent and a binding resin in the same layer.

The reason is that by allowing the same photoconductive layer to contain both of the hole transfer agent and the electron transfer agent, it may be possible to efficiently transfer charge generated from the oxo-titanyl phthalocyanine crystal which constitutes the charge generating agent at the time of exposure.

Further, as shown in FIG. 1B, a photoconductor 10' may be constituted by forming a barrier layer 16 between the base body 12 and the photoconductive layer 14 to the extent that the property of the photoconductor is not impeded.

Further, as shown in FIG. 1C, it may be possible to adopt a photoconductor 10" which has a protective layer 18 on a surface of the photoconductive layer 14.

2. Charge Generating Agent (1) Kinds

The charge generating agent used in the electrophotographic photoconductor of the present invention preferably includes an oxo-titanyl phthalocyanine compound which is expressed by following general formula (1).

The reason is that while non-metal phthalocyanine which is generally used as a material of the charge generating agent cannot achieve the sufficiently high sensitivity required by the electrophotographic photoconductor, the oxo-titanyl phthalocyanine compound expressed by the general formula (1) can remarkably enhance a quantum yield rate depending on a crystal type.

Here, as a specific example of the oxo-titanyl phthalocyanine compound expressed by the general formula (1), a compound expressed by the general formula (2) may be named.

(1)

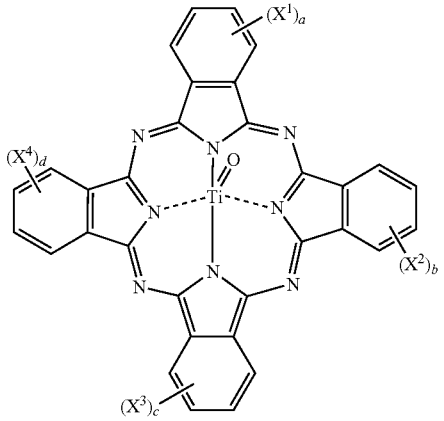

(In the general formula (1), $X^1$, $X^2$, $X^3$ and $X^4$ are substitutes which may be the same or different from each other and indicate a hydrogen atom, a halogen atom, an alkyl group, an alkoxy group, a cyano group or a nitro group, wherein the numbers of repetition a, b, c and d are respectively integers of 1 to 4 and may be the same or different each other.)

(2)

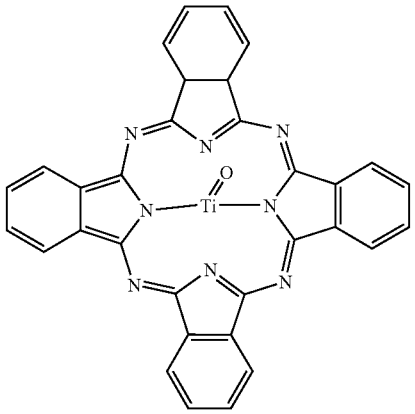

TiOPc

Further, the crystal type of the oxo-titanyl phthalocyanine compound may preferably be a Y-type.

The reason is that with the use of the Y-type oxo-titanyl phthalocyanine crystal, the quantum yield rate of the charge generating agent may be enhanced and hence, the sensitivity at the time of exposure may be enhanced. That is, with the quantum yield rate which amounts to approximately 90%, the charge may be generated efficiently corresponding to light radiated by the exposure and hence, the sensitivity at the time of exposure may be sufficiently enhanced.

(2) Optical Property and Thermal Property

Further, the charge generating agent may preferably contain the oxo-titanyl phthalocyanine crystal having both of properties (a) and (b) described below or either one of these properties (a) and (b).

(a) In the differential scanning calorimetry analysis, the oxo-titanyl phthalocyanine crystal does not have peaks within a range from 50° C. to 400° C. except for peaks attributed to the vaporization of absorption water.

(b) In the differential scanning calorimetry analysis, the oxo-titanyl phthalocyanine crystal does not have peaks within a range from 50° C. to 200° C. except for peaks attributed to vaporization of absorption water and has one peak within a range from 200° C. to 400° C.

The reason is that due to such a constitution, the stability with time and the dispersibility of the oxo-titanyl phthalocyanine crystal in a photoconductive layer coating liquid may be further enhanced.

To be more specific, when the oxo-titanyl phthalocyanine crystal possesses the property (a), the oxo-titanyl phthalocyanine crystal becomes stable crystal which hardly generates the crystal transition.

That is, even when the photoconductive layer coating liquid is manufactured and the coating liquid is used after storing for a fixed period, there exists little possibility that the oxo-titanyl phthalocyanine crystal of crystal transition from the Y-type to the α or β type due to an action of an organic solvent such as tetrahydrofuran contained in the photoconductive layer coating liquid. Accordingly, the oxo-titanyl phthalocyanine crystal can hold the Y-type which exhibits excellent property for generating the charge.

Further, when the oxo-titanyl phthalocyanine crystal possesses the property (b), the stability with time and the dispersibility of the oxo-titanyl phthalocyanine crystal in the photoconductive layer coating liquid may be further enhanced.

To be more specific, when the oxo-titanyl phthalocyanine crystal possesses the property (b), the oxo-titanyl phthalocyanine crystal can suppress the crystal transition in the organic solvent and, at the same time, can exhibit excellent dispersibility in the photoconductive layer coating liquid.

That is, in manufacturing the photoconductive layer coating liquid for manufacturing the photoconductive layer, the crystal type is not changed to the α type or the β type and the Y type is maintained and, at the same time, the dispersibility of oxo-titanyl phthalocyanine crystal in the photoconductive layer coating liquid is particularly enhanced and hence, the charge may be generated in the formed photoconductive layer extremely efficiently at the time of exposure. Further, due to such excellent dispersibility, the transfer of the charge between the oxo-titanyl phthalocyanine crystal and the charge transfer agent is performed efficiently and hence, the generation of a residual potential in the photoconductive layer may be prevented thus effectively suppressing the exposure memory.

Here, one peak within a range from 270° C. to 400° C. except for peaks attributed to the vaporization of absorption water is preferable to be a range from 290° C. to 400° C. It is still more preferable to be a range from 300° C. to 400° C.

Here, the oxo-titanyl phthalocyanine crystals having the properties (a) and (b) may be used in a single form respectively or may be used in combination.

Accordingly, when the oxo-titanyl phthalocyanine crystals having the properties (a) and (b) are used in combination, it is preferable to set a weight ratio between the oxo-titanyl phthalocyanine crystal having the property (a) and the oxo-titanyl phthalocyanine crystal having the property (b) to a value which falls within a range from 10/90 to 90/10. It is still more preferable to set such a weight ratio between these two crystals to a value which falls within a range from 20/80 to 80/20.

Further, the charge generating agent may preferably further contain oxo-titanyl phthalocyanine crystal other than the oxo-titanyl phthalocyanine crystal having property (a) or (b).

The reason is that the oxo-titanyl phthalocyanine crystal which does not have the property (a) or (b) may exhibit poor stability with time or poor dispersibility in a photoconductive layer coating liquid when the oxo-titanyl phthalocyanine crystal is used in a single form. However, by using such oxo-titanyl phthalocyanine crystal having the property (a) or (b), such a drawback may be remarkably overcome.

That is, with the use of a predetermined quantity of the oxo-titanyl phthalocyanine crystal having the property (a) or (b), even when the conventional oxo-titanyl phthalocyanine crystal which does not have the property (a) or (b) may be preferably used with the oxo-titanyl phthalocyanine crystal having the property (a) or (b) in combination. Accordingly, with the use of the oxo-titanyl phthalocyanine crystal having the plurality of properties in this manner as the charge generating agent, it may be possible to provide the electrophotographic photoconductor which can easily satisfy the formula (1) at a low cost.

Further, the charge generating agent may preferably contain oxo-titanyl phthalocyanine crystal having the following property (c).

(c) After immersing the electrophotographic photoconductor in an organic solvent for 24 hours, in a CuKα-property X-ray diffraction spectrum, a maximum peak appears at least at a Bragg angle of $2\theta \pm 0.2° = 27.2°$ and a peak is not present at the Bragg angle of 26.2°.

The reason is that when the oxo-titanyl phthalocyanine crystal possesses the property (c), the oxo-titanyl phthalocyanine crystal can surely control the crystal transition in the organic solvent.

That is, even when the oxo-titanyl phthalocyanine crystal is actually immersed in an organic solvent such as tetrahydrofuran for 24 hours, it is confirmed that the crystal type is not changed to the α type or the β type and the Y-type is held and hence, the crystal transition in the organic solvent may be surely controlled.

Here, a measuring method of the thermal property in the oxo-titanyl phthalocyanine crystal is described later in examples.

Further, the optical property of the oxo-titanyl phthalocyanine crystal may be measured as follows, for example.

That is, 0.3 g of Y-type oxo-titanyl phthalocyanine crystal is dispersed in 5 g of tetrahydrofuran, the mixture is held in a closed system under a condition of a temperature of 23±1° C. and a relative humidity 50 to 60% RH for 24 hours and, thereafter, the mixture is filled in a sample holder of an X-ray diffraction device (RINT1100 made by Rigaku Denki co. Ltd.) and may be measured under following conditions.

X-ray tube: Cu
tube voltage: 40 kV
tube current: 30 mA
start angle: 3.0°
stop angle: 40.0°
scanning speed: 10°/minute (3) Ionization Potential Further, it is preferable to set the ionization potential of the oxo-titanyl phthalocyanine which constitutes the charge generating agent to a value which falls within a range from 5.0 to 5.5 eV.

The reason is that when the value of the ionization potential is below 5.0 eV, the difference between this value and a value of the ionization potential of the hole transfer agent described later becomes excessively large and hence, there may be a case in which the efficient charge transfer becomes difficult and, as a result, the sensitivity of the photoconductor is lowered and the exposure memory is generated. On the other hand, when the value of the ionization potential exceeds 5.5 eV, the difference between this value and the value of the ionization potential of the hole transfer agent described later becomes excessively small and hence, the charge property of the photoconductor may be lowered.

Accordingly, it is preferable to set the ionization potential of the oxo-titanyl phthalocyanine to the value which falls within a range from 5.1 to 5.4 eV, and it is still more preferable to set such ionization potential to a value which falls within a range from 5.2 to 5.3 eV.

A measuring method of the ionization potential may use an atmosphere type ultraviolet light electron analyzer (AC-1 made by Riken Keiki Co., Ltd.), for example.

(4) Addition Quantity

Further, the addition quantity of the oxo-titanyl phthalocyanine crystal which constitutes the charge generating agent may preferably be set to a value which falls within a range from 0.6 to 3.0 weight % with respect to the total quantity of the photoconductive layer (100 weight %).

The reason is that by setting the addition quantity of the oxo-titanyl phthalocyanine crystal to the value which falls within such a range, when the photoconductor is exposed, the oxo-titanyl phthalocyanine crystal can effectively generate the charge and, at the same time, the charge transfer between the charge generating agent and the charge transfer agent may be efficiently performed.

That is, when the addition quantity of the oxo-titanyl phthalocyanine crystal is below 0.6 weight %, the charge generation quantity becomes insufficient and hence, there may be a case that it is difficult to form a predetermined electrostatic latent image on the photoconductor. On the other hand, when the addition quantity of the charge generating agent exceeds 3 weight %, there may be a case that it is difficult to uniformly disperse the oxo-titanyl phthalocyanine crystal in the photoconductive layer coating liquid.

Accordingly, it is more preferable to set the addition quantity of the charge generating agent to a value which falls within a range from 0.8 to 2.8 weight % with respect to a total quantity of the photoconductive layer (100 weight %).

3. Hole Transfer Agent (1) Kinds

As the hole transfer agent, any one of conventionally known various hole transferring compounds may be used.

For example, it may be possible to use a single kind or combination of two or more kinds of a benzidine compound, a phenylenediamine compound, a naphthylenediamine compound, a phenanthrylenediamine compound, an oxadiazole compound, a styryl compound, a carbazole compound, a pyrazoline compound, a hydrazone compound, a triphenylamine compound, an indole compound, an oxazole compound, an isoxazole compound, a thiazole compound, a thiadiazole compound, an imidazole compound, a pyrazole compound, a triazole compound, a butadiene compound, a pyrene-hydrazone compound, an acrolein compound, a carbazole-hydrazone compound, a quinoline-hydrazone compound, a stilbene compound, a stilbene-hydrazone compound and a diphenylenediamine compound.

Further, as specific example of the above-mentioned hole transfer agent, hole transfer agents (HTM-A to F) expressed by following formulae (3) to (8) are named.

(3)

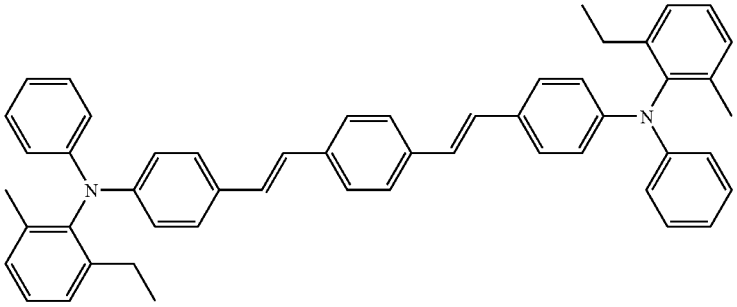

(HTM-A)

(4)

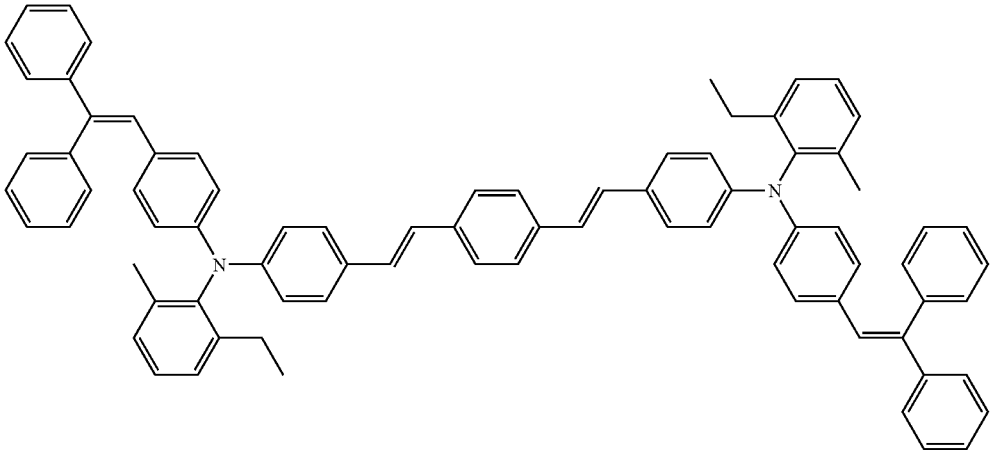

(HTM-B)

-continued (5)

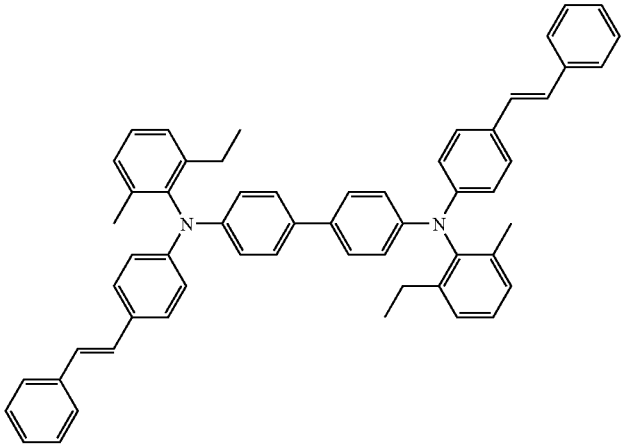

(HTM-C)

(6)

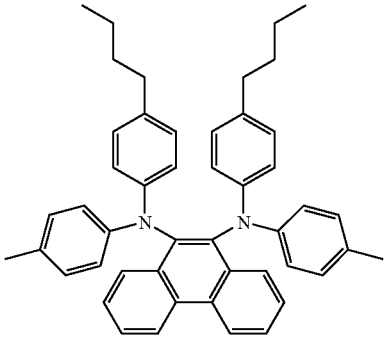

(HTM-D)

(7)

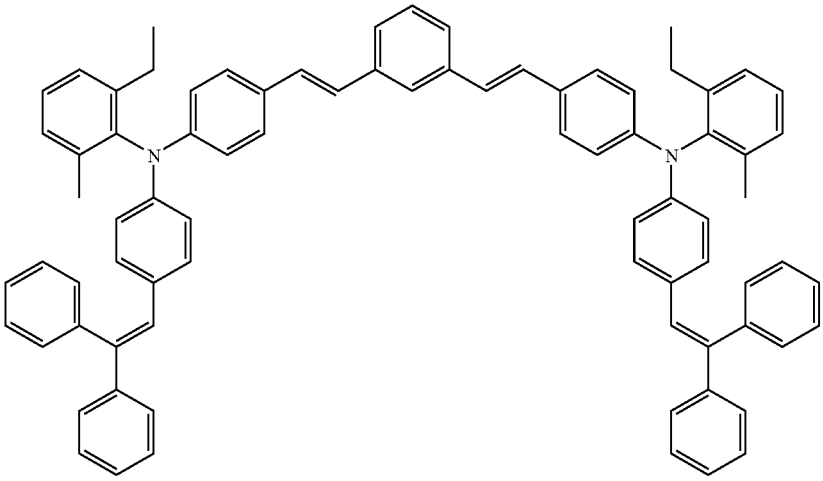

(HTM-E)

(8)

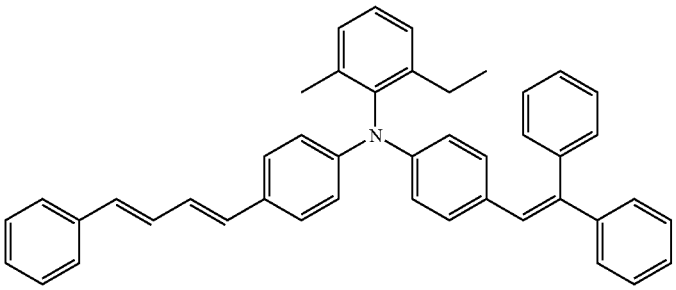

(HTM-F)

(2) Mobility

Further, as the hole transfer agent, among the above-mentioned general hole transfer agents, it is particularly preferable to use a hole transfer agent in which the mobility measured under conditions of concentration of 30 weight % and field density of $3.0\times10^5$ V/cm is set to a value which falls within a range from $5.0\times10^{-6}$ to $5.0\times10^{-4}$ $cm^2/V/sec$.

The reason is that by setting the mobility of the hole transfer agent to the value which falls within such a range, holes which are generated from the charge generating agent may be efficiently transferred thus suppressing the generation of the exposure memory more effectively.

That is, when the mobility of the hole transfer agent measured under conditions of the concentration of 30 weight % and field density of $3.0\times10^5$ V/cm is below $5.0\times10^{-6}$ $cm^2/V/sec$, it may be impossible to sufficiently transfer the holes generated by the exposure and hence, the charge remains in the inside of the photoconductive layer thus giving rise to the generation of the exposure memory and, at the same time, lowering the sensitivity. On the other hand, when the mobility of the hole transfer agent measured under conditions of the concentration of 30 weight % and field density of $3.0\times10^5$ V/cm exceeds $5.0\times10^{-4}$ $cm^2$/V/sec, the hole transfer ability is enhanced and hence, such mobility is preferable for suppressing the generation of the exposure memory and the enhancement of the sensitivity. However, the acquisition of the hole transfer agent which exhibits such high performance is difficult technically and in view of a cost. Further, a balance between the electron transfer ability of the electron transfer agent and the hole transfer ability of the hole transfer agent is destroyed thus giving rise to a possibility that the charge remains in the inside of the photoconductive layer.

Accordingly, it is more preferable to set the mobility of the hole transfer agent measured under conditions of concentration of 30 weight % and field density of $3.0\times10^5$ V/cm to a value which falls within a range from $1.0\times10^{-5}$ to $1.0\times10^{-4}$ $cm^2$/V/sec, and it is still more preferable to set the mobility of the hole transfer agent to a value which falls within a range from $2.0'10^{-5}$ to $5.0\times10^{-5}$ $cm^2$/V/sec.

(3) Ionization Potential

Among the above-mentioned general hole transfer agents, it is particularly preferable to use the hole transfer agent which has the ionization potential (eV) set to a value which falls within a range from 5.1 to 6.0 eV.

The reason is that by setting the ionization potential (eV) of the hole transfer agent to the value which falls within the range from 5.1 to 6.0 eV, as will be explained in detail in the next paragraph, it may be possible to easily adjust a value obtained by subtracting the ionization potential (eV) of the oxo-titanyl phthalocyanine compound from the value of the ionization potential (eV) of the hole transfer agent within a predetermined range. Accordingly, it is more preferable to set the ionization potential (eV) of the hole transfer agent to a value which falls within the range from 5.2 to 5.8 eV. It is still more preferable to set the ionization potential (eV) of the hole transfer agent to a value which falls within the range from 5.3 to 5.7 eV.

Further, it is preferable to use the hole transfer agent which sets the value obtained by subtracting the value of the ionization potential (eV) of the oxo-titanyl phthalocyanine compound from the value of the ionization potential (eV) of the hole transfer agent to a value which falls within a range from 0.1 to 0.4 (eV).

The reason is that with the use of the hole transfer agent which sets the value of the ionization potential (eV) of the hole transfer agent larger than the value of the ionization potential (eV) of the oxo-titanyl phthalocyanine compound by 0.1 to 0.4 eV, it may be possible to acquire the suppression of the exposure memory on the photoconductive layer and the enhancement of the sensitivity but also the improvement of the charging property.

That is, when the difference between the ionization potential (eV) of the hole transfer agent and the ionization potential (eV) of the oxo-titanyl phthalocyanine compound is below 0.1 eV, the difference between the ionization potential of the hole transfer agent and the ionization potential of the oxo-titanyl phthalocyanine compound becomes excessively small and hence, there exists a possibility that the charging property of the photoconductor is lowered.

On the other hand, when the difference between the ionization potential (eV) of the hole transfer agent and the ionization potential (eV) of the oxo-titanyl phthalocyanine compound exceeds 0.4 eV, it is difficult to acquire the efficient charge transfer and hence, there arises the possibility that the sensitivity is lowered or the exposure memory is generated.

Accordingly, it is more preferable to set the difference between the ionization potential (eV) of the hole transfer agent and the ionization potential (eV) of the oxo-titanyl phthalocyanine compound to a value which falls within a range from 0.12 to 0.35 eV, and it is still more preferable to set such difference to a value which falls within a range from 0.15 to 0.3 eV.

Here, a measuring method of the ionization potential of the hole transfer agent may use an atmosphere type ultraviolet light electron analyzer (AC-1 made by Riken Keiki Co., Ltd.), for example.

(4) Addition Quantity

Further, the addition quantity of the hole transfer agent may preferably be set to a value which falls within a range from 20 to 500 parts by weight with respect to 100 parts by weight of the binding resin.

The reason is that when the addition quantity of the hole transfer agent is below 20 parts by weight, there exists a possibility that a hole transfer function of the photoconductive layer is lowered thus adversely influencing image properties. On the other hand, when the addition quantity of the hole transfer agent exceeds 500 parts by weight, there exists a possibility that the dispersibility is lowered thus accelerating the crystallization.

Accordingly, it is more preferable to set the addition quantity of the hole transfer agent to a value which falls within a range from 30 to 200 parts by weight with respect to 100 parts by weight of the binding resin, and it is still more preferable to set such an addition quantity of the hole transfer agent to a value which falls within a range from 40 to 100 parts by weight.

4. Electron Transfer Agent (1) Reduction Potential

Further, the present invention is characterized by using an electron transfer agent which sets a reduction potential thereof to a value which falls within a range from −0.97 to −0.83 Vas the electron transfer agent used in the electrophotographic photoconductor of the present invention.

The reason is that by setting the reduction potential of the electron transfer agent to the value which falls within such a range, electrons generated from the charge generating agent may be efficiently transported thus suppressing the generation of the exposure memory more effectively and, at the same time, the sensitivity may be enhanced.

That is, when the reduction potential of the electron transfer agent is below −0.97 V, there arises a state in which electrons to be transferred cannot be separated from the electron transfer agent (carrier trap) and hence, there exists a possibility that the electron transfer efficiency is lowered. On the other hand, when the reduction potential of the electron transfer agent exceeds −0.83 V, energy level of a LUMO (a molecular trajectory having the lowest energy level among molecular trajectory having no electrons, wherein excited electrons usually move along this trajectory) becomes higher than an energy level of the oxo-titanyl phthalocyanine which constitutes the charge generating agent and hence, the electrons do not move to the electron transfer agent thus lowering a charge generation efficiency.

Figure 2:
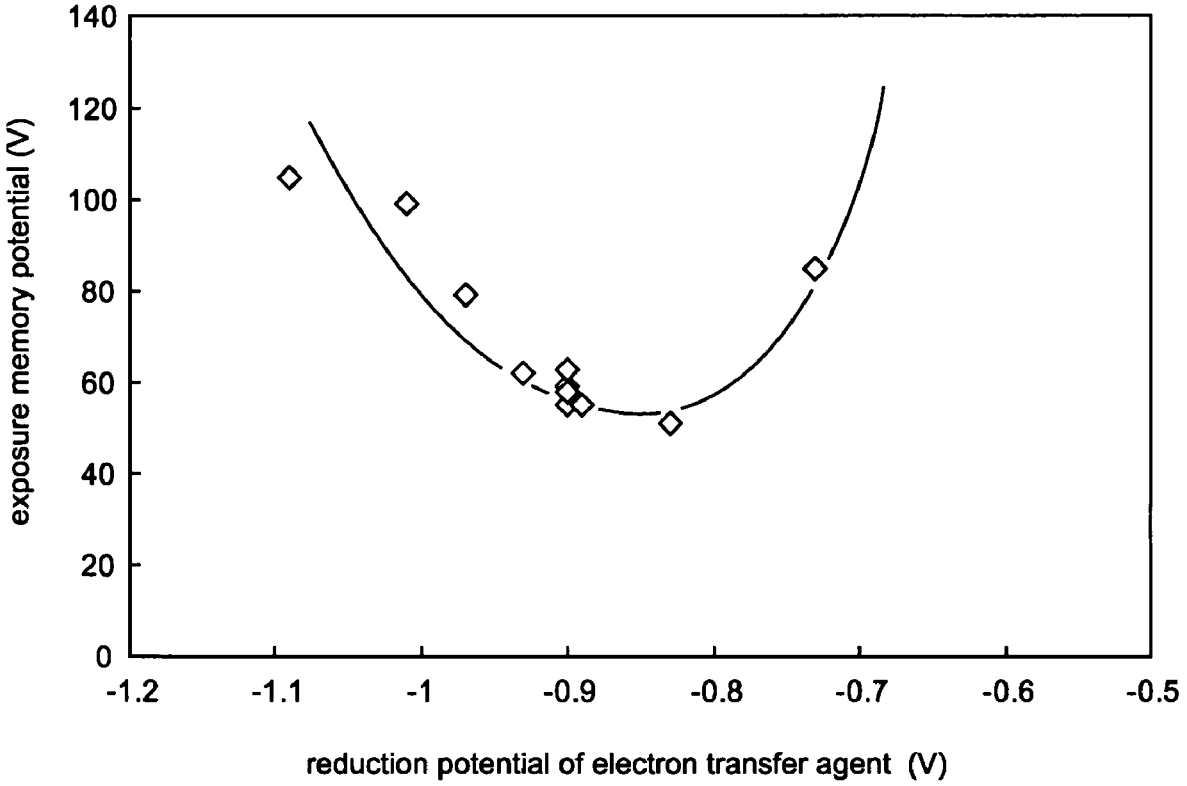
FIG. 2 is a view for explaining the relationship between a reduction potential of an electron transfer agent and an exposure memory potential.

Here, the relationship between the reduction potential of the electron transfer agent and the exposure memory potential is explained in conjunction with FIG. 2.

FIG. 2 shows characteristic curves in which the reduction potential (V) of the electron transfer agent is taken on an abscissas and the exposure memory potential (V) of the photoconductor is taken on an ordinates.

As may be understood from these characteristic curves, along with the increase of the value of the reduction potential (V) of the electro transfer agent, the value of the exposure memory potential (V) is critically changed thus forming a peak which projects downwardly.

To be more specific, it is understood that along with the increase of the value of the reduction potential (V) of the electrophotographic photoconductor from −1.01 V to −0.97 V, the value of the exposure memory (V) is lowered from 99 V to 79 V. Then, when the value of the reduction potential (V) of the electrophotographic photoconductor assumes a value which falls within a range from −0.97 V to −0.83 V, irrespective of the change of the value of the reduction potential (V), the exposure memory potential (V) assumes an approximately fixed value around 70 V. On the other hand, it is understood that when the reduction potential (V) of the electron transfer agent is increased from −0.83 V to −0.73 V, along with such an increase of the value of the reduction potential (V) of the electron transfer agent, the value of the exposure memory potential (V) is increased from 51 V to 85 V.

Accordingly, based on these characteristic curves, it is understood that when the value of the reduction potential (V) of the electron transfer agent assumes a value which falls within a range from −0.97 V to −0.83 V, electrons generated by the charge generating agent may be efficiently transferred and the value of the exposure memory potential (V) may be controlled to a low value equal to or less than 80 V.

Accordingly, it is understood that when the reduction potential of the electron transfer agent assumes a value which falls within a range from −0.97 V to −0.83 V, the generation of the exposure memory in the photoconductor may be effectively suppressed.

Accordingly, it is more preferable to set the reduction potential of the electron transfer agent to a value which falls within a range from −0.95 V to −0.85 V, and it is still more preferable to set such a reduction potential of the electron transfer agent to a value which falls within a range from −0.92 V to −0.88 V.

A measuring method of the exposure memory potential is explained later in conjunction with examples.

(2) Kinds

Further, as specific examples of the electron transfer agent which satisfies the above-mentioned conditions, electron transfer agents (ETM-A to F) expressed by following formulae (9) to (14) are named.

(9)

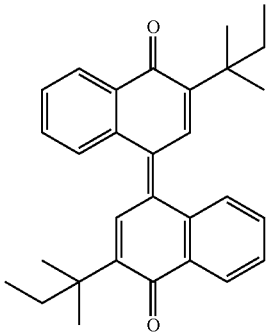

reduction potential -0.9 (V)
(ETM-A)

-continued (10)

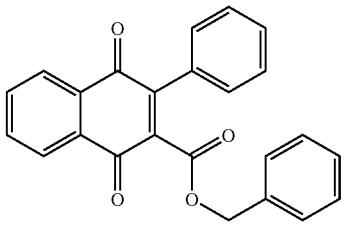

reduction potential -0.9 (V)
(ETM-B)

(11)

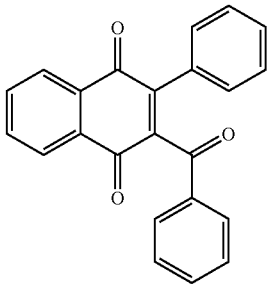

reduction potential -0.89 (V)
(ETM-C)

(12)

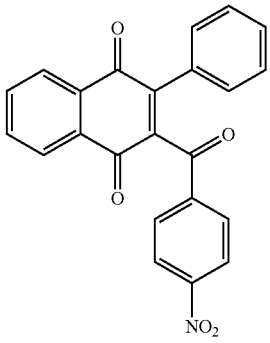

reduction potential -0.83 (V)
(ETM-D)

(13)

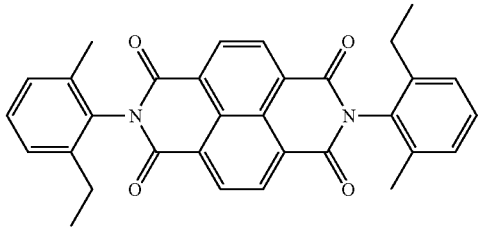

reduction potential -0.93 (V)
(ETM-E)

-continued (14)

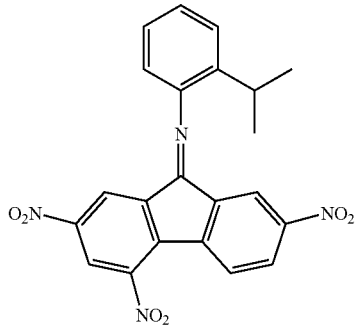

reduction potential -0.97 (V)
(ETM-F)

(3) Addition Quantity

Further, an addition quantity of the electron transfer agent may preferably be set to a value which falls within a range from 20 to 500 parts by weight with respect to 100 parts by weight of the binding resin.

The reason is that when the addition quantity of electron transfer agent is below 20 parts by weight, the sensitivity is lowered and a drawback may arise in a practical use. On the other hand, when the addition quantity of the electron transfer agent exceeds 500 parts by weight, the electron transfer agent is liable to be easily crystallized and hence, there may be a case in which forming of a film which is proper as the photoconductor becomes difficult.

Accordingly, it is more preferable to set the addition quantity of the electron transfer agent to a value which falls within a range from 30 to 200 parts by weight with respect to 100 parts by weight of the binding resin, and it is still more preferable to set such an addition quantity of the electron transfer agent to a value which falls within a range from 40 to 100 parts by weight with respect to 100 parts by weight of the binding resin.

5. Binding Resin

As the binding resin, for example, a thermoplastic resin such as a styrene polymer, a styrene-butadiene copolymer, a styrene-acrylonitrile copolymer, a styrene-maleic acid copolymer, an acrylic copolymer, a styrene-acrylic copolymer, polyethylene, an ethylene-vinyl acetate copolymer, a chlorinated polyethylene, polyvinyl chloride, polypropylene, a vinyl chloride-vinyl acetate copolymer, polyester, an alkyd resin, polyamide, polyurethane, polycarbonate, polyarylate, polysulfone, a diallyl phthalate resin, a ketone resin, a polyvinyl butyral resin and a polyether resin, a thermosetting resin such as a silicone resin, an epoxy resin, a phenol resin, a urea resin, a melamine resin and other crosslinking resin, and a photo curing resin such as epoxy-acrylate and urethane-acrylate may be named. These binding resins may be used in a single form respectively or in combination of two or more kinds of these binding resins.

Further, in constituting the electrophotographic photoconductor of the present invention, as a favorable binding resin, a Z-type polycarbonate resin including the structural unit expressed by the following formula (15) may be named.

(15)

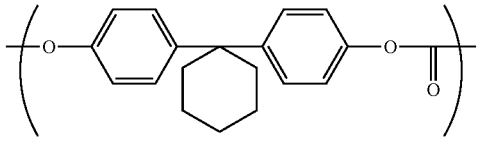

(Resin-A)

6. Other Additives

Further, besides the above-mentioned respective components, various kinds of additives such as, for example, a sensitizer, a fluorenone compound, an ultraviolet absorbing agent, a plasticizer, a surfactant and leveling agent may be added to the photoconductive layer. Further, to enhance the sensitivity of the photoconductor, the sensitizer such as, for example, terphenyl, halo naphthoquinone and acenaphthylene may be used together with the charge generating agent.

7. Base Body

As a base body on which the above-mentioned photoconductive layer is formed, various kinds of materials which have conductivity may be used. For example, a conductive base body made of metal such as iron, aluminum, copper, tin, platinum, silver, vanadium, molybdenum, chromium, cadmium, titanium, nickel, palladium, indium, stainless steel or brass, a base body made of a plastic material to which the above-mentioned metal is vapor-deposited or laminated, or a base body made of a glass which is covered with aluminum iodide, tin oxide, indium oxide or the like is illustrated.

That is, the base body per se may be made conductive or a surface of the base body may be conductive. Further, the base body may preferably possess a sufficient mechanical strength in use.

Further, the base body may have any shapes such as a sheet-like shape or a drum-like shape which conform to the structure of an image forming apparatus to be used.

8. Photoconductive Layer (1) Formula (1)

Further, the present invention may be also characterized in that the reflection absorbance (A/−) of the above-mentioned photoconductive layer with respect to light having a wavelength of 700 nm, a film thickness (d/m) of the photoconductive layer, and the concentration (C/weight %) of the oxo-titanyl phthalocyanine crystal of the photoconductive layer satisfy a following formula (1).

$$A \cdot C^{-1} \cdot d^{-1} > 1.75 \times 10^4 \quad (1)$$

The reason is that the photoconductive layer which satisfies the formula (1) can possess the sufficient dispersibility of oxo-titanyl phthalocyanine crystal which constitutes the charge generating agent in the photoconductive layer. Accordingly, any photoconductive layer which satisfies the formula (1) can effectively suppress the exposure memory. Further, when the exposure memory may be suppressed in this manner, the movement of the charge in the photoconductive layer is performed efficiently and hence, the sensitivity during the exposure may be also enhanced.

Here, a left term ($A \cdot C^{-1} \cdot d^{-1}$) in the formula (1) may be considered as a so-called parameter indicative of the dispersibility of oxo-titanyl phthalocyanine crystal of the photoconductive layer by applying the Lambert-Beer's Law with modification.

That is, provided that the film thickness (d/m) of the photoconductive layer and the concentration (C/weight %) of oxo-titanyl phthalocyanine crystal of the photoconductive layer are fixed, when the dispersibility of oxo-titanyl phthalocyanine crystal is insufficient, an incident light is hardly absorbed and hence, the reflection absorbance (A) is liable to take a small value with respect to light having a wavelength of 700 nm. On the other hand, when the dispersibility of oxo-titanyl phthalocyanine crystal is sufficient, the incident light is liable to be easily absorbed and hence, the reflection absorbance (A) of the conductive layer assumes a large value with respect to light having a wavelength of 700 nm.

Due to such a reason, it is understood that the dispersibility of oxo-titanyl phthalocyanine crystal of the conductive layer may be evaluated based on a value of the left term ($A \cdot C^{-1} \cdot d^{-1}$) in the formula (1).

Further, the relationship between a numeral value (unit:1/(weight %·m), the expression being applicable in the same manner hereinafter) of the left term $A \cdot C^{-1} \cdot d^{-1}$ in the formula (1) and the exposure memory potential of the photoconductor is explained in conjunction with FIG. 3.

Figure 3:
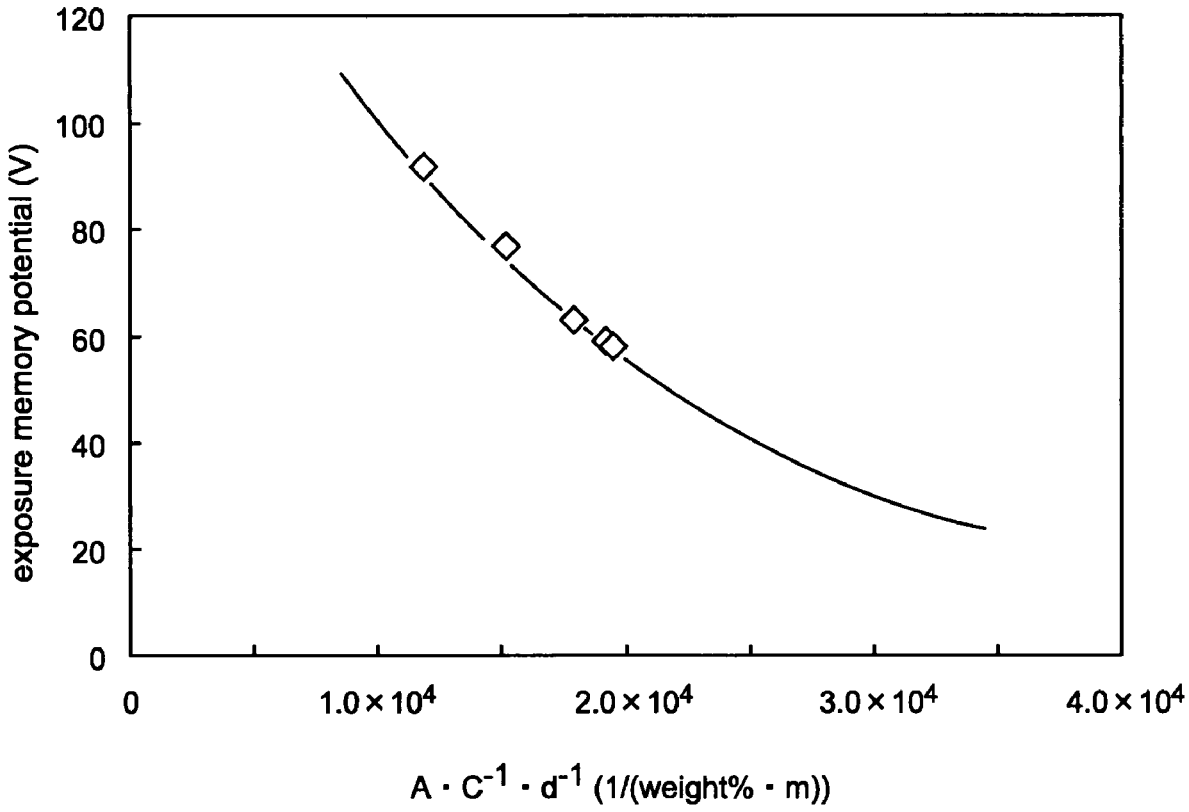
FIG. 3 is a view for explaining the relationship between a left term of the formula (1) and the exposure memory potential.

FIG. 3 shows characteristic curves in which the numeral value of the left term ($A \cdot C^{-1} \cdot d^{-1}$) in the formula (1) is taken on an abscissas and the exposure memory potential (V) of the photoconductor is taken on an ordinates.

As may be understood from these characteristic curves, the closer the value of the left term ($A \cdot C^{-1} \cdot d^{-1}$) in the formula (1) to 0, the value of the exposure memory potential (V) is increased, while along with the increase of the value of the left term ($A \cdot C^{-1} \cdot d^{-1}$) in the formula (1), the value of the exposure memory potential (V) is decreased. To be more specific, it is understood that when the value of the left term ($A \cdot C^{-1} \cdot d^{-1}$) in the formula (1) assumes a value which falls within a range from 0 to $1.75 \times 10^4$, along with the increase of the value of the left term ($A \cdot C^{-1} \cdot d^{-1}$), the value of the exposure memory potential (V) is sharply lowered. On the other hand, it is understood that when the value of the left term ($A \cdot C^{-1} \cdot d^{-1}$) in the formula (1) assumes a value which falls within a range exceeding $1.75 \times 10^4$, along with the increase of the value of the left term ($A \cdot C^{-1} \cdot d^{-1}$), the value of the exposure memory potential (V) is gradually lowered and takes a value which falls within a range below 60 V.

Accordingly, it is more preferable to set the left term ($A \cdot C^{-1} \cdot d^{-1}$) in the formula (1) to a value equal to or more than $1.9 \times 10^4$, and it is still more preferable to set the left term ($A \cdot C^{-1} \cdot d^{-1}$) in the formula (1) to a value equal to or more than $2.0 \times 10^4$.

(2) Reflection Absorbance

Further, it is preferable to set the reflection absorbance (A/−) of the photoconductive layer with respect to light having a wavelength of 700 nm to a value which falls within a range from 0.7 to 0.9.

The reason is that when the reflection absorbance of the photoconductive layer with respect to light having the wavelength of 700 nm is set to the value which falls within the range from 0.7 to 0.9, it may be possible to facilitate the formation of the photoconductive layer having properties which satisfy the formula (1) by adjusting the film thickness (d/m) of the photoconductive layer and the concentration (C/weight %) of the oxo-titanyl phthalocyanine crystal of the photoconductive layer. Further, with the reflection absorbance which falls within such a range, even under conditions prescribed by the formula (1), it may be possible to enhance the sensitivity while further effectively suppressing the exposure memory.

That is, when the reflection absorbance of the photoconductive layer with respect to the light having a wavelength of 700 nm is below 0.7, an addition quantity of the oxo-titanyl phthalocyanine crystal in the photoconductive layer is too small so that the charge generation quantity becomes insufficient thus giving rise to a possibility that a predetermined electrostatic latent image cannot be formed on the photoconductive layer. Alternatively, the film thickness of the photoconductive layer becomes excessively small and hence, there arises a possibility that a mechanical strength of the photoconductor becomes insufficient. On the other hand, when the reflection absorbance of the photoconductive layer with respect to the light having a wavelength of 700 nm exceeds 0.9, the film thickness of the photoconductive layer or the value of the concentration of the oxo-titanyl phthalocyanine crystal of the photoconductive layer is excessively increased thus giving rise to a possibility that it may be impossible to evaluate the dispersibility of the oxo-titanyl phthalocyanine crystal of the photoconductive layer using the formula (1).

Accordingly, it is more preferable to set the value of the reflection absorbance of the photoconductive layer with respect to light having a wavelength of 700 nm to a value which falls within a range from 0.72 to 0.88, and it is still more preferable to set such a reflection absorbance to a value which falls within a range from 0.75 to 0.85.

Here, a measuring method of the reflection absorbance is described in detail with respect to an example described later.

(3) Film Thickness

Further, the film thickness (d/m) of the photoconductive layer may preferably be set to a value which falls within a range from $5.0 \times 10^{-6}$ to $1.0 \times 10^{-4}$ m.

The reason is that when the film thickness(d/m) of the photoconductive layer is set to the value which falls within the range from $5.0 \times 10^{-6}$ to $1.0 \times 10^{-4}$ m, it may be possible to facilitate the formation of the photoconductive layer having properties which satisfy the formula (1) by adjusting the value of the reflection absorbance (A/−) of the photoconductive layer with respect to the wavelength of 700 nm and the concentration (C/weight %) of the oxo-titanyl phthalocyanine crystal of the photoconductive layer. Further, with the film thickness (d/m) of the photoconductive layer which falls within such a range, even under conditions prescribed by the formula (1), it may be possible to acquire the photoconductor which exhibits the excellent practicability.

That is, when the film thickness (d/m) of the photoconductive layer is below $5.0 \times 10^{-6}$, there may be a case in which a mechanical strength of the photoconductor becomes insufficient. On the other hand, when the film thickness (d/m) of the photoconductive layer exceeds $1.0 \times 10^{-4}$ m, there may be a case in which the base body is easily peeled off from the base body. Accordingly, the film thickness (d/m) of the photoconductive layer may preferably be set to a value which falls within a range from $1.0 \times 10^{-5}$ to $8.0 \times 10^{-5}$ m, and it is still more preferable to set such a film thickness (d/m) of the photoconductive layer to a value which falls within a range from $2.0 \times 10^{-5}$ to $4.0 \times 10^{-5}$ m.

9. Manufacturing Method

Further, in manufacturing the monolayer type photoconductor, the binding resin, the charge generating agent, the hole transfer agent and the electron transfer agent are added and mixed to the solvent in a dispersed state thus forming the photoconductive layer coating liquid. That is, in forming the monolayer type photoconductor by a coating method, the oxo-titanyl phthalocyanine crystal which constitutes the charge generating agent, the hole transfer agent, the electron transfer agent, the binding resin and the like may be mixed with the proper solvent in a dispersed state using a known method such as a roll mill, a ball mill, an atliter, a paint shaker, an ultrasonic dispersing unit or the like, for example, thus preparing a dispersed liquid and the dispersed liquid may be coated and dried using known units.

Here, as the solvent to form the photoconductive layer coating liquid, one, two or more kinds selected from a group consisting of tetrahydrofuran, dichloromethane, toluene, 1,4-dioxane, and 1-methoxy-2-propanol may be named.

Further, to enhance the dispersibility of the charge transfer agent or the charge generating agent or the smoothness of a surface of the photoconductive layer, a surfactant, a leveling agent or the like may be added to the photoconductive layer coating liquid.

Second embodiment

Further, according to a second aspect of the present invention, there is provided an image forming apparatus which includes an electrophotographic photoconductor, wherein the electrophotographic photoconductor has a monolayer type photoconductive layer including at least a charge generating agent, a hole transfer agent, an electron transfer agent and a binding resin on a substrate thereof, the charge generating agent contains oxo-titanyl phthalocyanine crystal, the electron transfer agent has a reduction potential thereof set to a value which falls within a range from −0.97 to −0.83 V, and the reflection absorbance (A/−) of the photoconductive layer with respect to light having a wavelength of 700 nm, a film thickness (d/m) of the photoconductive layer and the concentration (C/weight %) of the oxo-titanyl phthalocyanine crystal of the photoconductive layer satisfy a following formula (1).

$$A \cdot C^{-1} \cdot d^{-1} > 1.75 \times 10^4 \quad (1)$$

Hereinafter, contents which are already explained in the first embodiment are omitted, and the explanation is mainly made by focusing on points which relate to the second embodiment and which are different from the first embodiment.

Figure 4:
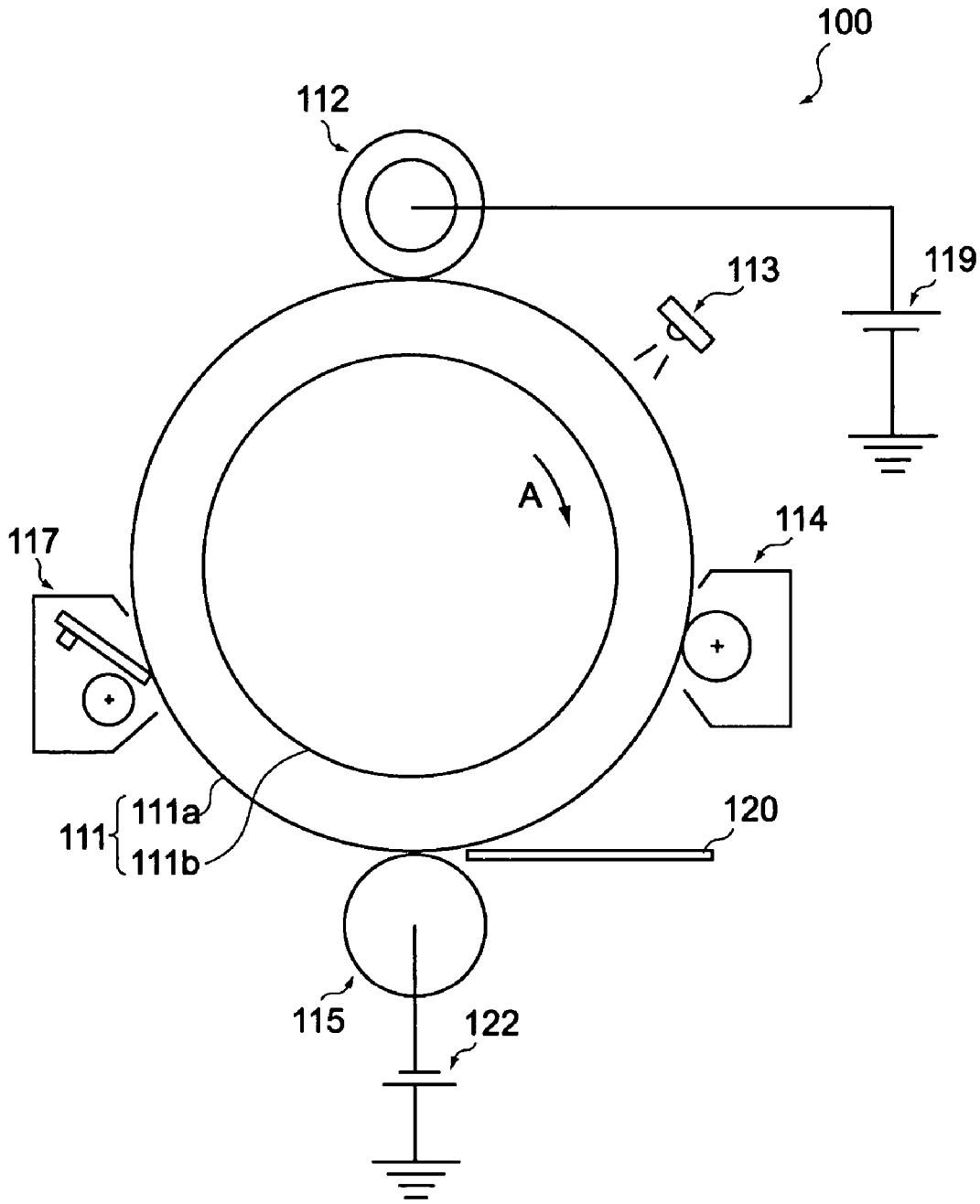
FIG. 4 is a view for explaining the schematic constitution of an image forming apparatus provided with an electrophotographic photoconductor.

That is, the image forming apparatus of the second embodiment may preferably formed of an image forming apparatus 100 having the constitution shown in FIG. 4.

Here, FIG. 4 is a schematic view showing the whole constitution of the image forming apparatus. Hereinafter, the manner of operation of the image forming apparatus is explained in order of steps.

First of all, a photoconductor 111 of the image forming apparatus 100 is rotated at a predetermined process speed (peripheral speed) in the direction indicated by an arrow A and, thereafter, a surface of the photoconductor 111 is charged with a predetermined potential using a charging unit 112.

Next, an exposure unit 113 exposes the surface of the photoconductor 111 via a reflection mirror or the like while performing the optical modulation corresponding to image information. An electrostatic latent image is formed on the surface of the photoconductor 111 by this exposure.

Subsequently, the latent image developing is performed by a developing unit 114 based on the electrostatic latent image. A toner is stored in the inside of the developing unit 114. A toner image is formed by applying the toner to the surface of the photoconductor 111 corresponding to the electrostatic image.

Further, a recording sheet 120 is transferred to a lower portion of the photoconductor 111 along a predetermined transfer conveyance path. Here, by applying a predetermined transfer bias between the photoconductor 111 and the transfer unit 115, it may be possible to transfer a toner image to the recording sheet 120.

Next, after the toner image is transferred to the recording sheet 120, the recording sheet 120 is separated from the surface of the photoconductor 111 by a separation unit (not shown in the drawings) and is conveyed to a fixing unit by using a conveying belt. Subsequently, the toner image is fixed to a surface of the recording sheet 120 by heating and pressuring treatments by the fixing unit and, thereafter, the recording sheet 120 is discharged to the outside of the image forming apparatus 100 by a discharge roller.

On the other hand, after the toner image is transferred, the photoconductor 111 continues the rotation thereof, and the residual toner (adhered material) which is not transferred to the recording sheet 120 at the time of transferring operation is removed by a cleaning unit 117 of the present invention from the surface of the photoconductor.

The present invention is characterized in that the above-mentioned photoconductor 111 has a monolayer type photoconductive layer including at least a charge generating agent, a hole transfer agent, an electron transfer agent and a binding resin on a substrate thereof, the charge generating agent contains oxo-titanyl phthalocyanine crystal, the electron transfer agent has a reduction potential thereof set to a value which falls within a range from −0.97 to −0.83 V, and the reflection absorbance (A/−) of the photoconductive layer with respect to light having a wavelength of 700 nm, a film thickness (d/m) of the photoconductive layer, and the concentration (C/weight %) of the oxo-titanyl phthalocyanine crystal of the photoconductive layer satisfy a following formula (1).

$$A \cdot C^{-1} \cdot d^{-1} > 1.75 \times 10^4 \quad (1)$$

Accordingly, as described in detail in the first embodiment, the photoconductor 111 effectively suppresses the exposure memory and, at the same time, exhibits the excellent sensitivity at the time of exposure.

Accordingly, the image forming apparatus 100 of the present invention can print the high-quality image from which the exposure memory is suppressed at a high speed.

Further, it is preferable that the image forming apparatus 100 of the present invention does not have an electricity neutralizing unit.

The reason is that, as mentioned above, the image forming apparatus 100 of the present invention can sufficiently suppress the exposure memory and hence, even when a step which erases the exposure memory and the like by using the electricity neutralizing unit is omitted, it may be possible to form a high quality image.

Accordingly, the constitution of the image forming apparatus 100 may be simplified and, at the same time, the miniaturization of the image forming apparatus 100 may be realized.

EXAMPLE

Hereinafter, the present invention is specifically explained in detail in conjunction with examples. However, the present invention is not limited to the contents of the description.

Example 1

1. Manufacture of Electrophotographic Photoconductor By using a ball mill, 3 parts by weight of Y-type oxo-titanyl phthalocyanine (TiOPc) which is expressed by the formula (2) and has the property which is expressed by (TiOPc-A) in Table 1, 30 parts by weight of the electron transfer agent (ETM-A) in which the reduction potential expressed by the formula (9) is −0.90 V, 45 parts by weight of the hole transfer agent (HTM-A) expressed by the formula (3), and 100 parts by weight of Z-type polycarbonate (Resin-A) (TS2020 made by Teijin Chemistry Ltd.) expressed by the formula (15) having the viscosity average molecular weight of 20,000 as the binding resin are mixed in a dispersed manner with 800 parts by weight of tetrahydrofuran for 50 hours thus manufacturing the phosphor layer coating liquid.

Next, the photoconductive layer coating liquid is applied to an aluminum-made drum-shaped support body having a diameter of 30 mm and a length of 254 mm which constitutes the base body by using a dip coating method. Thereafter, the photoconductive layer coating liquid is dried with hot air at a temperature of 100° C. for 40 minutes thus preparing an electrophotographic photoconductor having a monolayer type photoconductive layer having a thickness of $2.5\times10^{-5}$ m.

TABLE 1

| Charge generating agent | property |
|---|---|
| TiOPc-A | TiOPc having no peaks within a range between 50 to 400° C. except for a peak appearing along with vaporization of an absorbed water in differential scanning calorimetry analysis. |
| TiOPc-B | TiOPc having no peaks within a range between 50 to 200° C. except for a peak appearing along with vaporization of an absorbed water and has one peak in a range from 200 to 400° C. in differential scanning calorimetry analysis |
| TiOPc-C | TiOPc prepared by mixing TiOPc-A and TiOPc-D at a ratio (weight ratio) of 2:1 |
| TiOPc-D | Conventional TiOPc other than TiOPc-A, TiOPc-B and the like |
| TiOPc-E | TiOPc prepared by mixing TiOPc-A and TiOPc-D at a ratio (weight ratio) of 1:1 |

TiOPc-A are prepared by a method described in the U.S. Pat. No. 3,463,032, which corresponds to U.S. Pat. No. 6,528,645.

TiOPc-B is prepared by a method described in example 7.

2. DSC Measurement of Oxo-titanyl Phthalocyanine Crystal

Figure 5:
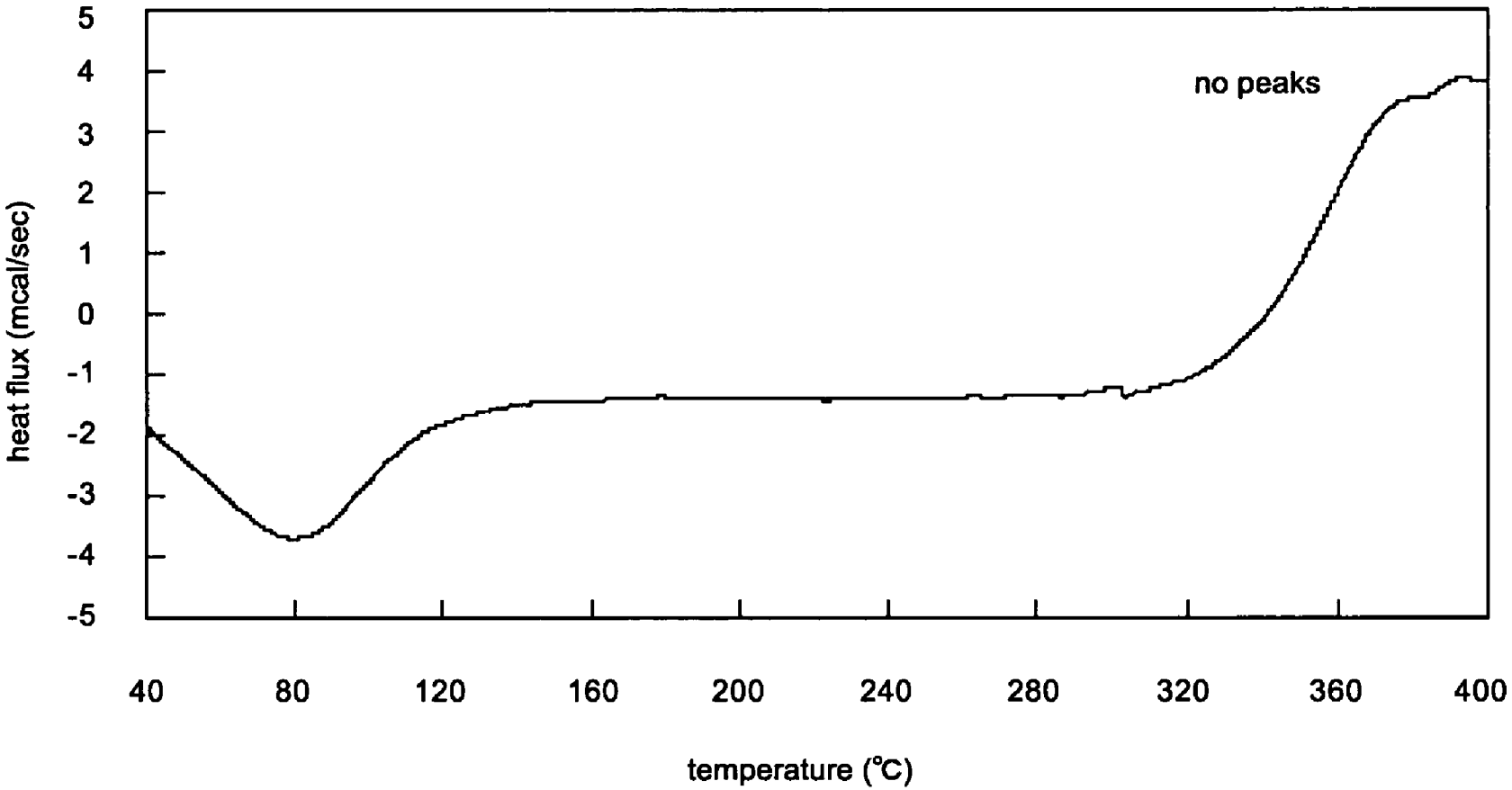
FIG. 5 is a chart showing a differential scanning calorimetry analysis of TiPc-A which constitutes a charge generating agent.

Further, the DSC (differential scanning calorimetry) analysis of oxo-titanyl phthalocyanine crystal (TiOPc-A) used in the example 1 is performed by using a differential scanning calorimeter (TAS-200, DSC8230D made by RIGAKU Corporation). The measurement condition is as follows. Here, a chart of obtained differential scanning calorimetry analysis is shown in FIG. 5.

sample pan: aluminum temperature elevation speed: 20° C./minute

3. Evaluation of Electrophotographic Photoconductor (1) Measurement of Reflection Absorbance Further, a reflection absorbance ($A_1$) with respect to light having a wavelength of 700 nm in the support base body on which the obtained photoconductive layer (reference thickness of $2.5\times10^{-5}$ m) is stacked is measured by using a color difference meter (color difference meter CM1000 made by Minolta Co. Ltd.). Next, a reflection absorbance ($A_2$) with respect to light having a wavelength of 700 nm in a support base body on which the obtained photoconductive layer is not stacked is measured in the same manner.

Figure 6:
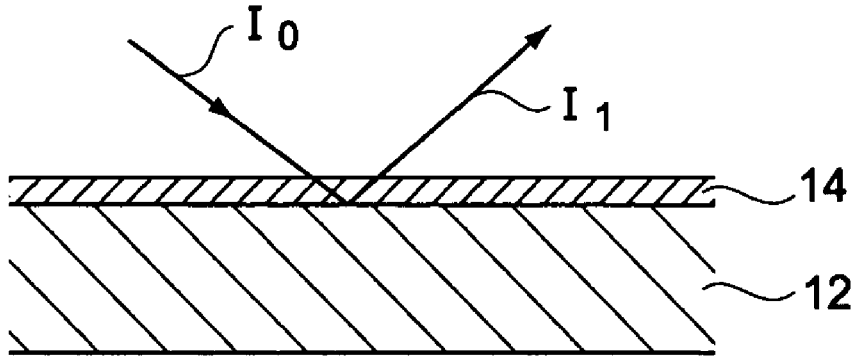
FIG. 6 is a view for explaining a measuring method of the reflection absorbance of a photoconductive layer.
Figure 6:
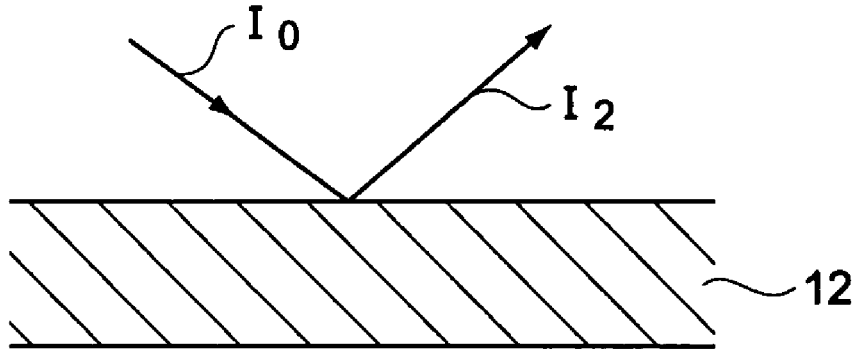

That is, to explain the electrophotographic photoconductor more specifically in conjunction with FIG. 6A and FIG. 6B, FIG. 6A shows a state in which a photoconductive layer 14 is stacked on a support base body 12, while FIG. 6B shows a state in which only the support base body 12 is present. Here, symbol $I_0$ in FIG. 6A and 6B indicates an intensity of light (incident light) radiated to each support base body, and symbols $I_1$ and $I_2$ in FIG. 6A and 6B indicate intensities of reflection light corresponding to the incident lights radiated to the respective support base bodies. Accordingly, to acquire the reflection absorbance of the photoconductive layer by neutralizing the influence of the support base body, $A_2$ indicative of the reflection absorbance of the support base body may be subtracted from $A_1$ in which the reflection absorbance of the photoconductive layer and the reflection absorbance of the support base body are present in mixture.

Accordingly, the reflection absorbance (A) of an intermediate layer is calculated based on the obtained reflection absorbance values ($A_1$, $A_2$) using a following formula (1):

$$A=A_1-A_2 \tag{1}$$

and with respect to the reflection absorbance (A), the evaluation of the dispersibility of oxo-titanyl phthalocyanine crystal of the photoconductive layer is performed in view of the following criteria. Obtained result is shown in Table 1.

Here, the reflection absorbance ($A_1$) shown in FIG. 6A is calculated by using the following formula (2):

$$A_1=-\mathrm{Log}\, l_1/l_0 \tag{2}$$

In the same manner, the reflection absorbance ($A_2$) shown in FIG. 6B is calculated by using the following formula (3):

$$A_2=-\mathrm{Log} l_2 l_0 \tag{3}$$

Then, the larger the reflection absorbance (A) of the photoconductive layer is, the more light is absorbed by the photoconductive layer. That is, this result implies that the dispersibility of oxo-titanyl phthalocyanine crystal of the photoconductive layer is high. Here, the reflection absorbance (A) of the photoconductive layer in the example 1 is 0.810.

Here, the calculation of $A\cdot C^{-1}\cdot d^{-1}$ in the example 1 is specifically explained.

First of all, the concentration C is obtained based on a rate of (TiO Pc-A) with respect to a total 178.0 parts by weight consisting of 3 parts by weight of (TiOPc-A), 30 parts by weight of electron transfer agent (ETM-A), 45 parts by weight of hole transfer agent (HTM-A) and 100 parts by weight of binding resin. That is the concentration (C=1.69 (weight%)) is calculated by (3/178.0)×100=1.69. By substituting such a value and the above-mentioned reflection absorbance and film thickness of the photoconductive layer in $A\cdot C^{-1}\cdot d^{-1}$ respectively, $1.92\times10^4$ is obtained ($A\cdot C^{-1}\cdot d^{-1}=0.810/[1.69(\text{weight\%})\times2.5\times10^{-5}(\text{m})]=1.92\times10^4$).

(2) Measurement of Exposure Memory Potential

Further, the obtained exposure memory potential of the electrophotographic photoconductor is measured under the following conditions.

That is, the obtained electrophotographic photoconductor is mounted on a printer (Antico40 made by Kyocera Mita Corp.) from which an electricity neutralizing lamp is omitted. A surface potential of an unexposed portion (corresponding to a blank part corresponding to a formed image) and a surface potential after performing a charging step of the exposed portion (corresponding to a black matted portion in a formed image) are measured, and the difference between these potentials is evaluated as an exposure memory potential in accordance with following criteria. An obtained result is shown in Table 2.

E (Excellent): The memory potential value is below 70(V).

G (Good): The memory potential value is 70 to below 80(V).

F (Fair): The memory potential value is 80 to below 90(V).

B (bad): The memory potential value is 90(V) or more.

(3) Measurement of Sensitivity

Further, the measurement of sensitivity of the obtained photoconductor is performed under following conditions.

That is, in a state that the surface potential of the photoconductor is charged with +850 V by using a drum sensitivity tester (made by GENTEC Corporation), a monochromatic light having a wavelength of 780 nm (half value width of 20 nm, light intensity of 1.5 $\mu J/m^2$) which is taken out from a white light of a halogen lamp by using a band pass filter is radiated to a surface of the photoconductor for 50 msec. Next, a surface potential at a point of time that 0.35 seconds elapses from starting of the exposure is measured as the sensitivity. Further, a result of the measurement is evaluated in accordance with following criteria. The obtained result is shown in Table 2.

E (Excellent): The value of the sensitivity is below 100(V).

G (Good): The value of the sensitivity is 100(V) to below 150(V).

B (Bad): The value of the sensitivity is 150(V) or more.

(4) Total Evaluation

Further, a total evaluation which synthesizes the evaluations of the above-mentioned exposure memory potential and sensitivity is performed in accordance with following criteria. The obtained result is shown in Table 2.

E (Excellent): The excellent evaluation is received in all items.

G (Good): The good evaluation is received in one item and the excellent evaluation is received in remaining items in all items.

B (Bad): The fair or bad evaluation is received in at least one item in all items.

Examples 2 to 9

In the examples 2 to 9, in manufacturing the photoconductor, in place of the Y-type oxo-titanyl phthalocyanine crystal (TiOPc-A) and the electron transfer agent (ETM-A) expressed by the formula (9) which are used in the example 1, Y-type oxo-titanyl phthalocyanine crystals (TiOPc-A to C) and electron transfer agents (ETM-A to F) expressed by the formulae (9) to (14) which are shown in Table 2 respectively are used. Except for the above difference, the photoconductors are manufactured respectively in the same manner as the example 1 and are evaluated. Obtained results are shown in Table 2.

Here, the properties which the respective Y-type oxo-titanyl phthalocyanine crystals (TiOPc-D) possess are shown in Table 1.

Further, a manufacturing method of the Y-type oxo-titanyl phthalocyanine crystals (TiOPc-B) used in the examples 7 and 8 is described below.

1. Manufacture of Titanyl Phthalocyanine

In a flask which is substituted with argon, 22 g (0.17 mol) of o-phthalonitrile, 25 g(0.073 mol) of titanium tetra butoxide, 2.28 g (0.038 mol) of urea and 300 g of quinoline are filled and a temperature of the mixture is elevated to 150° C. while agitating the mixture. Next, the temperature of the mixture is elevated to 215° C. while removing vapor generated from a reaction system to the outside of the system by distillation. Then, the mixture is further agitated and reacted with each other for 2 hours by maintaining the reaction temperature.

After the completion of the reaction, at a point of time that the mixture is cooled to 150° C., a reacted mixture is taken out from the flask and is filtered by a glass filter, and an obtained solid material is sequentially cleaned using N,N-dimethyl formamide and methanol and, thereafter, the solid material is dried under vacuum thus obtaining 24 g of blue-violet solid material.

2. Preparation of Titanyl Phthalocyanine Crystal (1) Pre-step of Acid Treatment 10 g of blue-violet solid material obtained by the above-mentioned manufacture of titanyl phthalocyanine compound is added into 100 milliliter of N,N-dimethyl formamide, and the agitation of the liquid is performed for 2 hours in a state that the liquid is heated up to 130° C. while being agitated. Next, heating is stopped at a point of time that 2 hours elapse and, after cooling the mixture to 23±1° C., the agitation is stopped. Then, the liquid is held still in such a state for 12 hours for performing the stabilization treatment. Next, the stabilized liquid is filtered by using a glass filter, the obtained solid is cleaned by using ethanol and, thereafter, is dried under vacuum thus obtaining 9.83 g of coarse crystal of titanyl phthalocyanine compound.

(2) Acid Treatment Step 5 g of coarse crystal of titanyl phthalocyanine compound obtained by the above-mentioned pre-step of acid treatment is dissolved by adding 100 milliliter of concentrated sulfuric acid. Next, the solution is dropped in water which is cooled by ice and, thereafter, the solution is agitated at a room temperature for 15 minutes. Then, the solution is held still at a temperature of approximately 23±1° C. for 30 minutes for recrystallization. Next, the above-mentioned liquid is filtered by using a glass filter, the obtained solid material is washed with water until a cleaning liquid becomes neutral and, thereafter, in a state that the liquid is not dried and water is present in the liquid, the liquid is dispersed in 200 milliliter of chlorobenzene and the mixture is heated to a temperature of 50° C. and is agitated for 10 hours. Next, the liquid is filtered by using a glass filter and, thereafter, the obtained solid material is dried in vacuum for 5 hours thus obtaining 4.1 g of titanyl phthalocyanine crystal (blue powder) with no substitution expressed by the formula (2).

Figure 7:
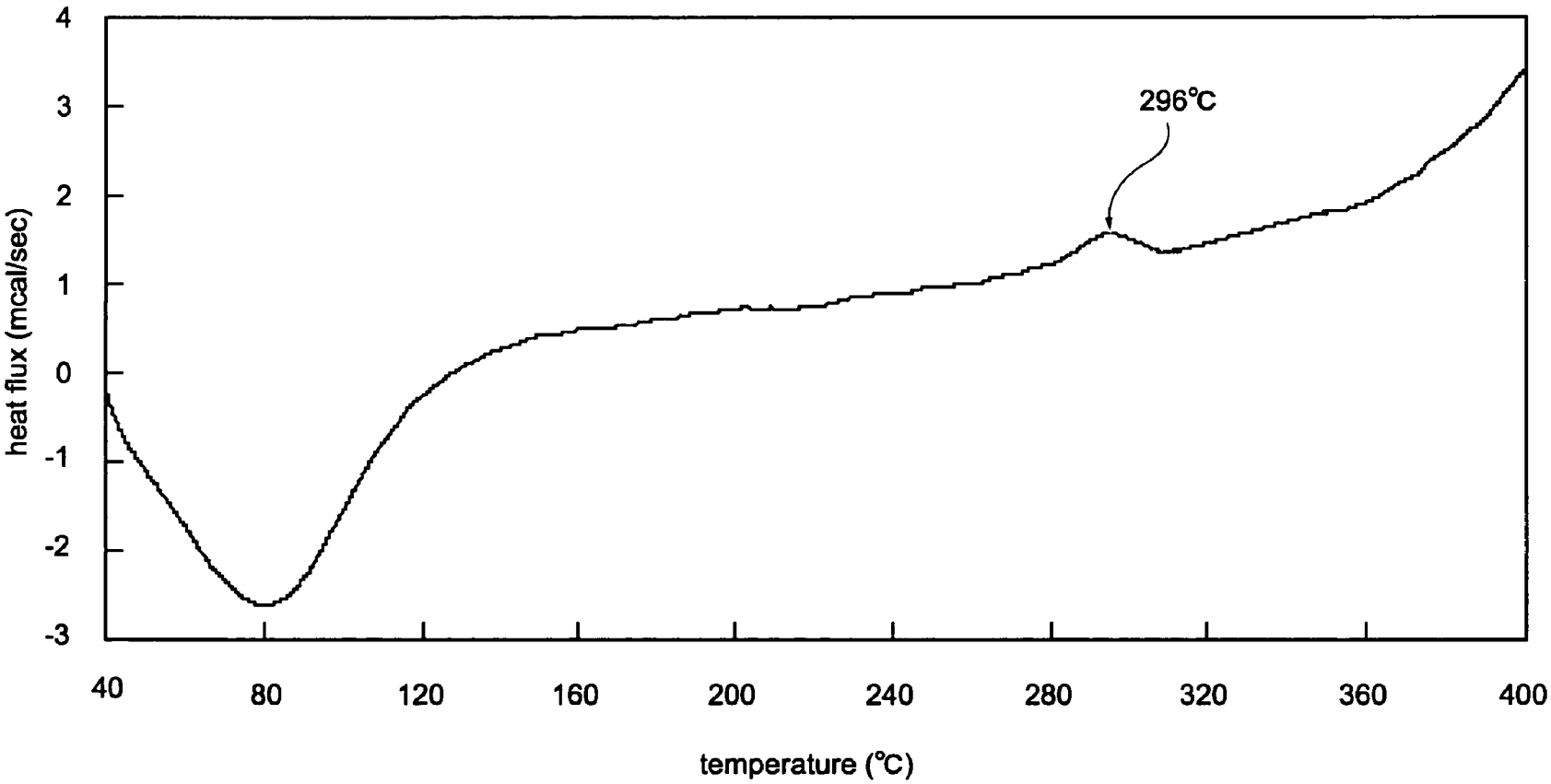
FIG. 7 is a chart showing a differential scanning calorimetry analysis of TiPc-B which constitutes a charge generating agent.

Further, the differential scanning calorimetry analysis of Y-type oxo-titanyl phthalocyanine (TiOPc-B) used in the examples 7 and 8 is performed in the same manner as the example 1. Here, the obtained chart of differential scanning calorimetry analysis is shown in FIG. 7.

Comparison Examples 1 and 2

In the comparison examples 1 and 2, in manufacturing the photoconductor, in place of the Y-type oxo-titanyl phthalocyanine crystal (TiOPc-A) and the electron transfer agent (ETM-A) expressed by the formula (9) which are used in the example 1, Y-type oxo-titanyl phthalocyanine crystal (TiOPc-D) and electron transfer agents (ETM-A and B) expressed by the formulae (9) and (10) which are shown in Table 2 respectively are used. Except for the above difference, the photoconductors are manufactured respectively in the same manner as the example 1 and are evaluated. Obtained results are shown in Table 2.

Here, the properties which the used Y-type oxo-titanyl phthalocyanine crystal (TiOPc-D) possesses are shown in Table 1.

Comparison Example 3

In the comparison example 3, in manufacturing the photoconductor, in place of the electron transfer agent (ETM-A) expressed by the formula (9) which are used in the example 1, an electron transfer agent (ETM-G) expressed by the formula (16) is used. Except for the above difference, the photoconductor is manufactured in the same manner as the example 1 and is evaluated. The obtained result is shown in Table 2.

(16)

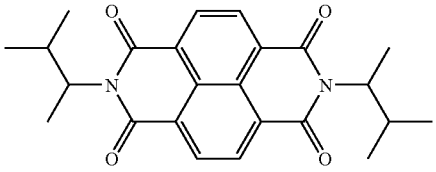

reduction potential -1.09 (V)
(ETM-G)

Comparison Example 4

In the comparison example 4, in manufacturing the photoconductor, in place of the electron transfer agent (ETM-A) expressed by the formula (9) which are used in the example 1, an electron transfer agent (ETM-H) expressed by the formula (17) is used. Except for the above difference, the photoconductor is manufactured in the same manner as the example 1 and is evaluated. The obtained result is shown in Table 2.

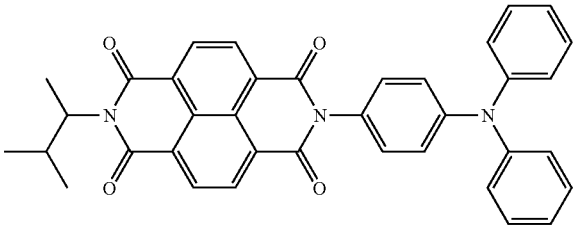

reduction potential -1.01 (V)
(ETM-H)

Comparison Examples 5 and 6

In the comparison examples 5 and 6, in manufacturing the photoconductor, in place of the Y-type oxo-titanyl phthalocyanine crystal (TiOPc-A) and the electron transfer agent (ETM-A) expressed by the formula (9) which are used in the example 1, Y-type oxo-titanyl phthalocyanine crystal (TiOPc-E) and electron transfer agents (ETM-A and B) expressed by the formulae (9) and (10) which are shown in Table 2 respectively are used. Except for the above difference, the photoconductors are manufactured respectively in the same manner as the example 1 and are evaluated. The obtained results are shown in Table 2.

Here, the properties which the used Y-type oxo-titanyl phthalocyanine crystal possesses are shown in Table 1.

Comparison Example 7

In the comparison example 7, in manufacturing the photoconductor, in place of the Y-type oxo-titanyl phthalocyanine crystal (TiOPc-A) which are used in the example 1, an x-type non-metal titanyl phthalocyanine crystal (x-H2Pc) is used. Except for the above difference, the photoconductor is manufactured in the same manner as the example 1 and is evaluated. The obtained result is shown in Table 2.

Comparison Example 8

In the comparison example 8, in place of the electron transfer agent (ETM-A) expressed by the formula (9) which is used in the example 1, an electron transfer agent (ETM-I) expressed by the formula (18) is used. Except for the above difference, the photoconductor is manufactured in the same manner as the example 1 and is evaluated. The obtained result is shown in Table 2.

(18)

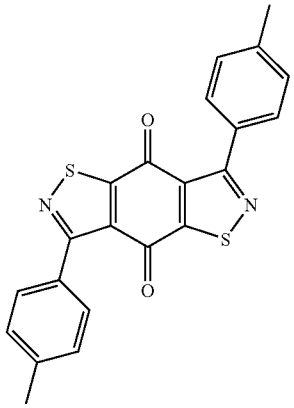

reduction potential -0.73
(ETM-I)

TABLE 2

| | | charge | electron transfer agent | | sensitivity evaluation | | exposure memory evaluation | | |
|---|---|---|---|---|---|---|---|---|---|
| | $A \cdot C^{-1} \cdot d_{-}^{1}$ (1/(weight % · m)) | generating agent | kind | reduction potential (V) | measured value (V) | evaluation | measured value (V) | evaluation | total evaluation |
| Example 1 | $1.92 \times 10^{-4}$ | TiOPc-A | ETM-A | −0.9 | 82 | E | 59 | E | E |
| Example 2 | $1.93 \times 10^{-4}$ | TiOPc-A | ETM-B | −0.9 | 101 | G | 55 | E | G |
| Example 3 | $1.96 \times 10^{-4}$ | TiOPc-A | ETM-C | −0.89 | 99 | E | 55 | E | E |
| Example 4 | $1.89 \times 10^{-4}$ | TiOPc-A | ETM-D | −0.83 | 95 | E | 51 | E | E |
| Example 5 | $2.01 \times 10^{-4}$ | TiOPc-A | ETM-E | −0.93 | 85 | E | 62 | E | E |
| Example 6 | $1.79 \times 10^{-4}$ | TiOPc-C | ETM-A | −0.9 | 88 | E | 63 | E | E |

TABLE 2-continued

| | | charge | electron transfer agent | | sensitivity evaluation | | exposure memory evaluation | | |
|---|---|---|---|---|---|---|---|---|---|
| | $A \cdot C^{-1} \cdot d^{-1}$ (1/(weight % · m)) | generating agent | kind | reduction potential (V) | measured value (V) | evaluation | measured value (V) | evaluation | total evaluation |
| Example 7 | $1.95 \times 10^{-4}$ | TiOPc-B | ETM-A | −0.9 | 86 | E | 58 | E | E |
| Example 8 | $1.94 \times 10^{-4}$ | TiOPc-B | ETM-B | −0.9 | 109 | G | 63 | E | G |
| Example 9 | $1.98 \times 10^{-4}$ | TiOPc-A | ETM-F | −0.97 | 89 | E | 79 | G | G |
| Comparison Example 1 | $1.19 \times 10^{-4}$ | TiOPc-D | ETM-A | −0.9 | 102 | G | 92 | B | B |
| Comparison Example 2 | $1.18 \times 10^{-4}$ | TiOPc-D | ETM-B | −0.9 | 91 | E | 88 | F | B |
| Comparison Example 3 | $1.96 \times 10^{-4}$ | TiOPc-A | ETM-G | −1.09 | 111 | G | 105 | B | B |
| Comparison Example 4 | $1.94 \times 10^{-4}$ | TiOPc-A | ETM-H | −1.01 | 120 | G | 99 | B | B |
| Comparison Example 5 | $1.52 \times 10^{-4}$ | TiOPc-E | ETM-A | −0.9 | 91 | G | 97 | B | B |
| Comparison Example 6 | $1.52 \times 10^{-4}$ | TiOPc-E | ETM-B | −0.9 | 129 | G | 94 | B | B |
| Comparison Example 7 | $3.01 \times 10^{-4}$ | x-H2Pc | ETM-A | −0.9 | 161 | B | 103 | B | B |
| Comparison Example 8 | $1.97 \times 10^{-4}$ | TiOPc-A | ETM-I | −0.73 | 120 | G | 85 | F | B |

INDUSTRIAL APPLICABILITY

According to the electrophotographic photoconductor and the image forming apparatus of the present invention, by setting the reflection absorbance, the film thickness and the like of the photoconductive layer such that the formula (1) is satisfied and by limiting the kinds of the charge generating agent in use and the properties of the electron transfer agent in use in the monolayer type photoconductor, it may be possible to achieve not only the suppression of the exposure memory but also the enhancement of the sensitivity.

Accordingly, the electrophotographic photoconductor and the image forming apparatus of the present invention are expected to contribute to the realization of high quality and the high-speed operation of the image forming apparatus.

What we claim is:

1. An electrophotographic photoconductor which has a monolayer type photoconductive layer including at least a charge generating agent, a hole transfer agent, an electron transfer agent and a binding resin on a substrate, wherein the charge generating agent contains a first titanyl phthalocyanine crystal, the electron transfer agent has a reduction potential thereof set to a value which falls within a range from −0.97 to −0.83 V, and the reflection absorbance A(−) of the photoconductive layer with respect to light having a wavelength of 700 nm, a film thickness d(m) of the photoconductive layer, and the concentration C(weight %) of the first titanyl phthalocyanine crystal of the photoconductive layer (100 weight %) satisfy a following formula (1):

$$A \cdot C^{-1} \cdot d^{-1} > 1.75 \times 10^4 \quad (1)$$

wherein the charge generating agent contains the first titanyl phthalocyanine crystal which possesses following properties (a) and (b) or either:

(a) in the differential scanning calorimetry analysis, the first titanyl phthalocyanine crystal does not have peaks within a range from 50° C. to 400° C. except for peaks attributed to the vaporization of absorption water, (b) in the differential scanning calorimetry analysis, the first titanyl phthalocyanine crystal does not have peaks within a range from 50° C. to 200° C. except for peaks attributed to vaporization of absorption water and has one peak within a range from 270° C. to 400° C.; and wherein the charge generating agent further contains a second titanyl phthalocyanine crystal other than the first titanyl phthalocyanine crystal having properties (a) or (b).

2. The electrophotographic photoconductor according to claim. 1, wherein the electrophotographic photoconductor contains a third titanyl phthalocyanine crystal having a following property (c) as the third titanyl phthalocyanine crystal, (c) After immersing the electrophotographic photoconductor in an organic solvent for 24 hours, in a CuKα-property X-ray diffraction spectrum, a maximum peak appears at least at a Bragg angle of 2θ±0.2°=27.2° and a peak is not present at the Bragg angle of 26.2°.

3. The electrophotographic photoconductor according to claim 1, wherein the concentration of the first titanyl phthalocyanine crystal C (weight %) in the monolayer type photoconductive layer (100 weight %) is set to a value which falls within a range from 0.6 to 3.0 weight %.

4. An image forming apparatus which includes an electrophotographic photoconductor, wherein the electrophotographic photoconductor has a monolayer type photoconductive layer including at least a charge generating agent, a hole transfer agent, an electron transfer agent and a binding resin on a substrate thereof;

the charge generating agent contains titanyl phthalocyanine crystal, the electron transfer agent has a reduction potential thereof set to a value which falls within a range from −0.97 to −0.83 V, and the reflection absorbance A(−) of the photoconductive layer with respect to light having a wavelength of 700 nm, a film thickness d(m) of the photoconductive layer, and the concentration C(weight %) of the titanyl phthalocyanine crystal of the photoconductive layer (100 weight %) satisfy a following formula (1), $$A \cdot C^{-1} \cdot d^{-1} > 1.75 \times 10^4 \quad (1)$$

wherein the charge generating agent contains the titanyl phthalocyanine crystal which possesses following properties (a) and (b) or either:

(a) in the differential scanning calorimetry analysis, the titanyl phthalocyanine crystal does not have peaks within a range from 50° C. to 400° C. except for peaks attributed to the vaporization of absorption water, (b) in the differential scanning calorimetry analysis, the titanyl phthalocyanine crystal does not have peaks within a range from 50° C. to 200° C. except for peaks attributed to vaporization of absorption water and has one peak within a range from 270° C. to 400° C.; and wherein the charge generating agent further contains titanyl phthalocyanine crystal other than the titanyl phthalocyanine crystal having properties (a) or (b).

5. The image forming apparatus according to claim 4, wherein the image forming apparatus does not include an electricity neutralizing means.

* * * * *